US006920832B2

(12) United States Patent
Lou-Hao

(10) Patent No.: US 6,920,832 B2
(45) Date of Patent: Jul. 26, 2005

(54) TABLE WITH LEG LOCK

(75) Inventor: Leng Lou-Hao, Xiamen (CN)

(73) Assignee: Cosco Management, Inc., Wilmington, DE (US)

( * ) Notice: Subject to any disclaimer, the term of this patent is extended or adjusted under 35 U.S.C. 154(b) by 160 days.

(21) Appl. No.: 10/376,825

(22) Filed: Feb. 28, 2003

(65) Prior Publication Data

US 2003/0164123 A1 Sep. 4, 2003

(30) Foreign Application Priority Data

Mar. 1, 2002 (CN) ..... 02213033 U

(51) Int. Cl.[7] ..... A47B 3/00

(52) U.S. Cl. ..... 108/132; 108/129; 248/439; 248/188.6

(58) Field of Search ..... 108/115, 150, 108/129, 131, 133, 132; 248/188.1, 188.6, 166, 439, 440

(56) References Cited

U.S. PATENT DOCUMENTS

| | | | | |
|---|---|---|---|---|
| 2,680,662 A | | 6/1954 | Adler | |
| 2,730,418 A | | 1/1956 | Blink | |
| 2,921,825 A | | 1/1960 | Spiegel | |
| 3,143,982 A | | 8/1964 | Blink et al. | |
| 3,416,486 A | | 12/1968 | Peterson et al. | |
| 3,554,141 A | * | 1/1971 | Burr | 108/132 |
| 3,661,100 A | | 5/1972 | Tennant | |
| 3,662,694 A | * | 5/1972 | Mitchell | 108/131 |
| 3,777,675 A | | 12/1973 | Hanusiak | |
| 3,945,328 A | * | 3/1976 | Hendrickson et al. | 108/132 |
| 4,111,482 A | | 9/1978 | Jones | |
| 4,561,622 A | * | 12/1985 | Heinzel | 248/439 |
| 4,821,650 A | * | 4/1989 | Simpson | 108/120 |
| 5,284,100 A | | 2/1994 | Thorn | |
| 5,345,881 A | * | 9/1994 | Loescher | 108/132 |
| 5,357,872 A | | 10/1994 | Wilmore | |
| 5,394,808 A | | 3/1995 | Dutro et al. | |
| 5,490,467 A | * | 2/1996 | Diffrient | 108/133 |
| 5,540,158 A | | 7/1996 | Ford | |
| 5,623,882 A | | 4/1997 | Price | |
| 6,032,585 A | | 3/2000 | Pinch | |
| 6,112,674 A | | 9/2000 | Stanford | |
| 6,374,756 B1 | * | 4/2002 | Fieldwick et al. | 108/131 |

FOREIGN PATENT DOCUMENTS

| | | | | |
|---|---|---|---|---|
| FR | 2547489 A2 | * | 12/1984 | 108/115 |

* cited by examiner

*Primary Examiner*—Lanna Mai
*Assistant Examiner*—Hanh V. Tran
(74) *Attorney, Agent, or Firm*—Barnes & Thornburg LLP

(57) ABSTRACT

A table includes a table top, a leg, and a leg lock. The leg is arranged to rotate relative to the table top between extended and collapsed orientations. The leg lock is arranged to lock the leg in the extended and collapsed orientations.

20 Claims, 20 Drawing Sheets

TABLE WITH LEG LOCK

Foreign priority is hereby claimed under 35 U.S.C. §119 to Chinese Patent Application No. 02213033.0 filed in the People's Republic of China on Mar. 1, 2002, the disclosure of which is hereby incorporated by reference herein.

BACKGROUND

The present disclosure relates to tables. In particular, it relates to tables including a leg lock to lock a leg of the table.

Tables typically include a table top and one or more movable legs to support the table top. A leg lock may be used to lock the leg against movement relative to the table top.

SUMMARY

According to the present disclosure, a table includes a table top and a leg arranged to move relative to the table top between extended and collapsed orientations. A leg lock is arranged to lock the leg in the extended orientation and in the collapsed orientation. The leg lock includes an adjustment device and a rotation blocker. The adjustment device is movable between a leg-locking orientation and a leg-unlocking orientation to move the leg relative to the rotation blocker. In the leg-locking orientation, the rotation blocker blocks rotation of the leg between the extended and collapsed orientations to lock the leg in the extended orientation when the leg is oriented in the extended orientation and to lock the leg in the collapsed orientation when the leg is oriented in the collapsed orientation. In the leg-unlocking orientation, the leg is allowed to rotated between the extended and collapsed orientations.

In one embodiment, the rotation blocker includes a tab positioned inside a channel of a frame member coupled to an underside of the table. The adjustment device includes a slide arranged to move in the channel to move the leg into and out of engagement with the rotation blocker to lock and unlock the leg in either the extended orientation or the collapsed orientation upon rotation of a rotatable leg actuator.

In another embodiment, the rotation blocker is provided by end and outer surfaces of the frame member containing the slide. Engagement between the leg and the end surface is used to lock the leg in the extended orientation. Engagement between the leg and the outer surface is used to lock the leg in the collapsed orientation.

Additional features and advantages of the apparatus will become apparent to those skilled in the art upon consideration of the following detailed description exemplifying the best mode as presently perceived.

BRIEF DESCRIPTION OF THE DRAWINGS

The detailed description particularly refers to the accompanying figures in which.

DETAILED DESCRIPTION OF THE DRAWINGS

Figure 1:
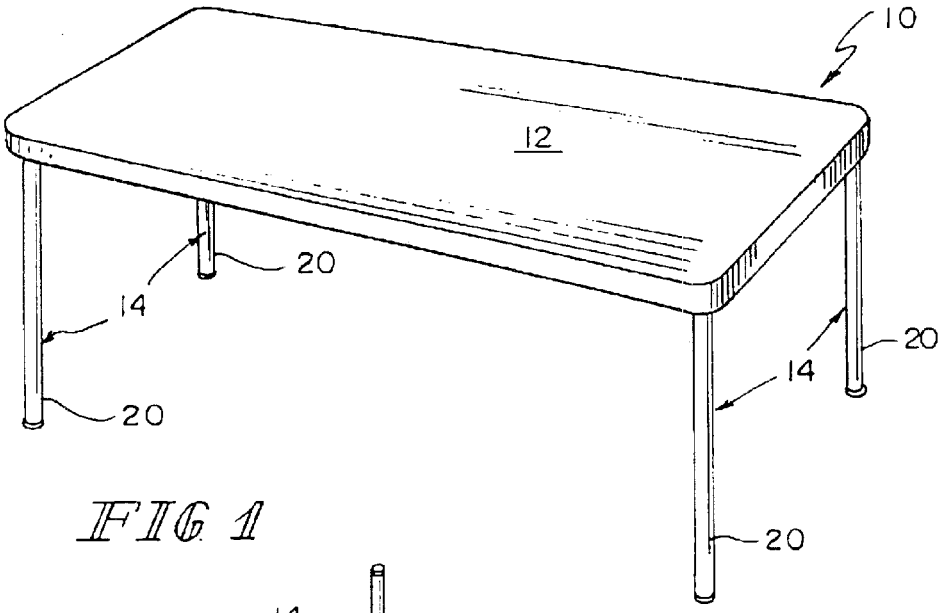
FIG. 1 is a perspective view of a table including a table top and legs locked in an extended orientation.
Figure 2:
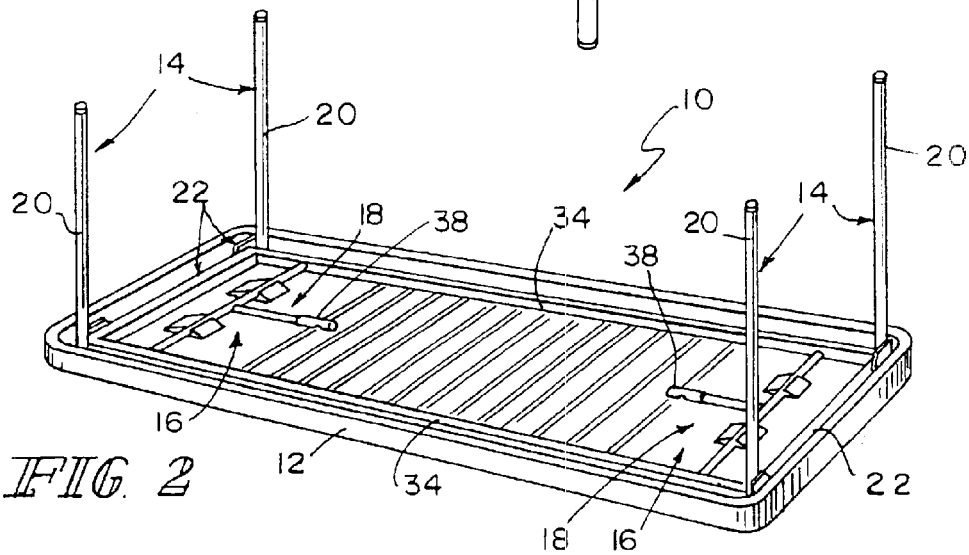
FIG. 2 is a perspective view of the table upside down showing a pair of leg locks including handles extending inwardly in a leg-locking orientation to lock the legs in the extended orientation.
Figure 3:
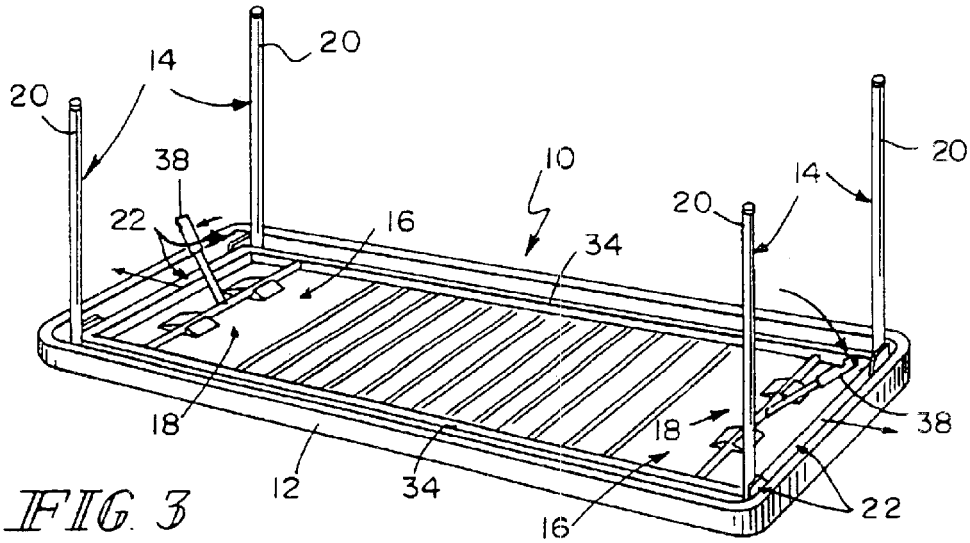
FIG. 3 is a perspective view of the table upside down showing the handles rotated outwardly to a leg-unlocking orientation to move the legs outwardly to unlock the legs to allow the legs to be collapsed.
Figure 4:
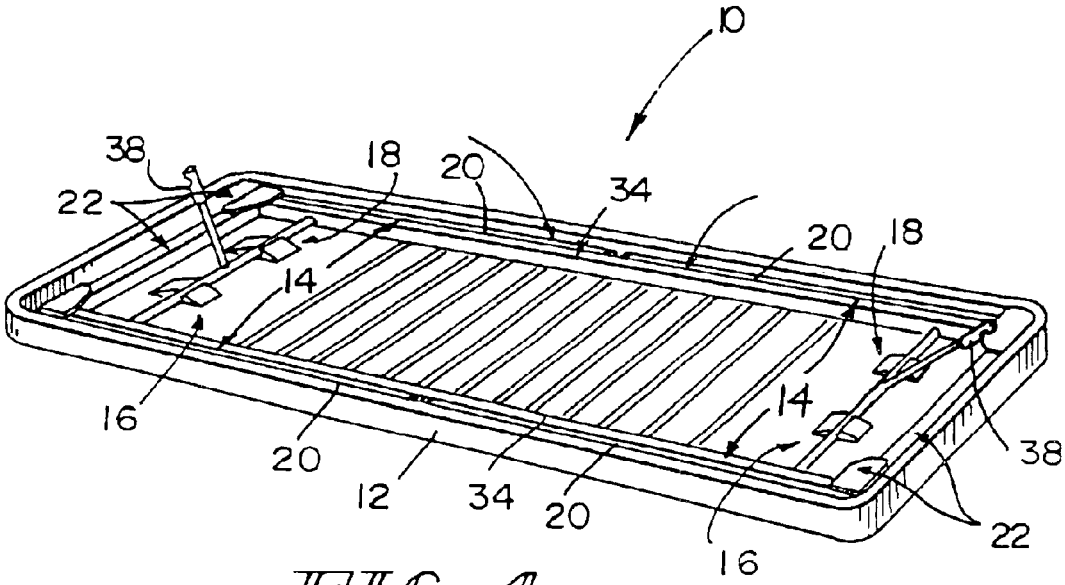
FIG. 4 is a perspective view of the table upside down showing the legs rotated to a collapsed orientation while the handles are rotated to their leg-unlocking orientation.
Figure 5:
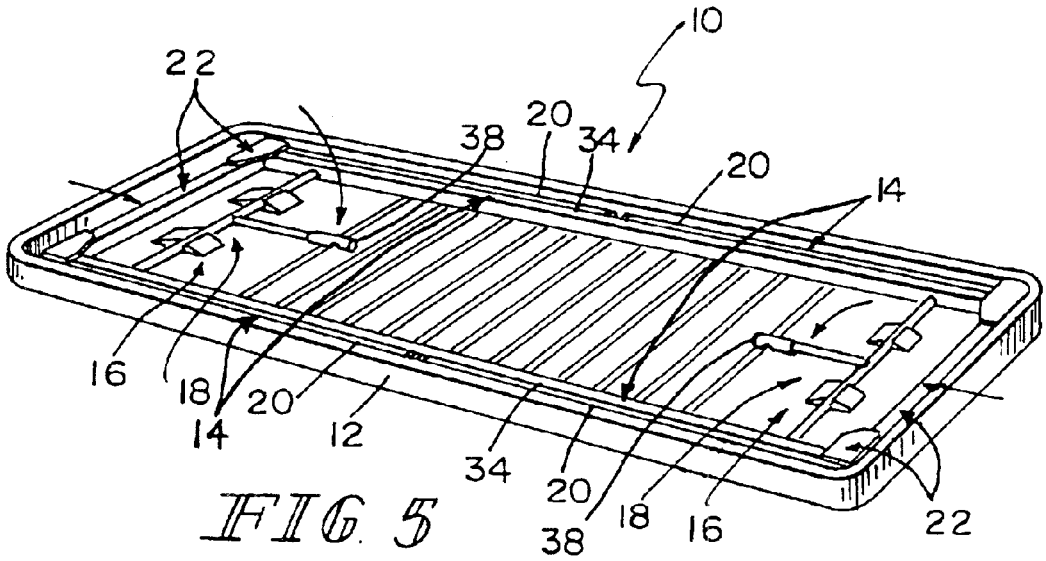
FIG. 5 is a perspective view of the table upside down showing the handles rotated inwardly back to their leg-locking orientations to move the legs inwardly to lock the legs in the collapsed orientation.

A table 10 is shown in FIG. 1. The table 10 includes a table top 12 and a pair of legs 14 to support the table top 12. Each leg 14 is arranged to rotate relative to the table top 12 between an extended orientation, as shown in FIGS. 1–3, and a collapsed orientation, as shown in FIGS. 4 and 5. The table 10 further includes a leg lock 16 for each leg 14, as shown in FIGS. 2–5, to lock the leg 14 in the extended and collapsed orientations and to unlock the leg 14 for rotation between the extended and collapsed orientations.

FIGS. 2–5 provide an overview of how the leg locks 14 work to lock and unlock the legs 14 in the extended and collapsed orientations. Each leg lock 14 includes an adjustment device 18 including a rotatable handle 38. To lock the legs 14 in the extended orientation, the handles 38 are rotated inwardly, as shown in FIG. 2. The handles 38 may be rotated outwardly to move the legs outwardly to unlock the legs 14 for rotation from the extended orientation to the collapsed orientation, as shown in FIG. 3. Once the legs 14 are unlocked, they may be rotated to the collapsed orientation while the handles 38 remain rotated outwardly, as shown in FIG. 4. The handles 38 may then be rotated back to their initial position to move the legs 14 inwardly to lock the legs 14 in the collapsed orientation. Details of the legs 14 and leg locks 16 are now discussed.

The legs 14 are structurally and functionally similar to one another so that the discussion below of one of the legs 14 applies to the other leg 14 as well. In addition, the leg locks 16 are structurally and functionally similar to one another so that the discussion below of one of the leg locks 16 applies also to the other leg lock 16.

Figure 6:
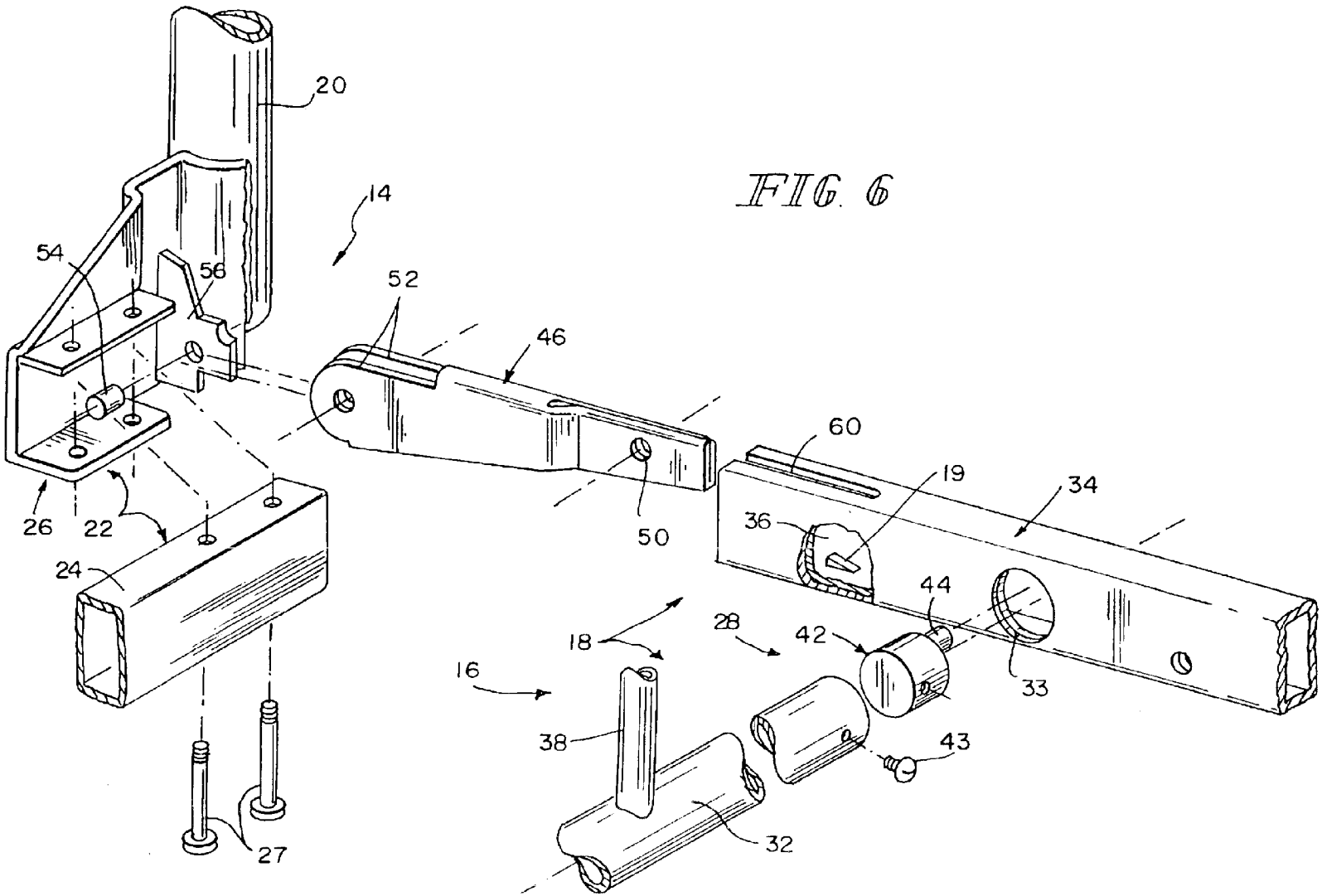
FIG. 6 is an exploded perspective view, with portions broken away, showing one of the legs (on the left side of the page) including a leg member and a leg member support including a bracket coupled to the leg member and a rotatable support shaft to be coupled to the bracket and showing one of the leg locks (to the right of the leg) including a slide to be coupled to a tongue of the bracket and to be positioned inside a channel of a frame member, a rotation blocker in the form of a tab inside the channel for engagement with the tongue to block rotation of the leg, and a rotatable actuator including a rotatable actuator shaft, a handle coupled to the actuator shaft, and an eccentric element to extend inside the channel for engagement with the slide to move the slide back and forth to move the tongue toward and away from the tab in response to rotation of the actuator shaft by the handle.

The leg 14 includes a pair of leg members 20 and a leg member support 22 arranged to support the leg members 20 for rotation between the extended and collapsed orientations, as shown in FIGS. 2–5. The leg member support 22 includes a support shaft 24 and a pair of brackets 26 coupled to the support shaft 24 by fasteners 27 and welded to the leg members 20, as shown in FIG. 6 with respect to one leg member 22 and one bracket 26. Each bracket 26 includes a locking tongue 56, which is discussed in more detail below.

The adjustment device 18 of the leg lock 16 is arranged to move between a leg-locking orientation and a leg-unlocking orientation. The leg-locking orientation is used to lock the leg 14 in the extended orientation when the leg 14 is oriented in the extended orientation, as shown in FIGS. 2 and 7–9, and is used to lock the leg in the collapsed orientation when the leg 14 is oriented in the collapsed orientation, as shown in FIGS. 5 and 16–18. The leg 14 is allowed to rotated between the extended and collapsed orientations when the adjustment device is oriented in the leg-unlocking orientation, as shown in FIGS. 3, 4, and 10–15.

In moving between the leg-locking and leg-unlocking orientations, the adjustment device 18 moves the leg 14 relative to a pair of rotation blockers 19, one of which is shown in FIG. 6. Each rotation blocker 19 is configured as a tab positioned inside a channel 36 provided by an inner surface of an elongated, hollow frame member 34. The rotation blocker 19 is welded to the frame member 32. As such, the rotation blocker 19 may be thought of as being included in the frame member 34. The frame members 34 are coupled to an underside of the table top 12 for support thereof and provide a frame of the table 10.

Figure 7:
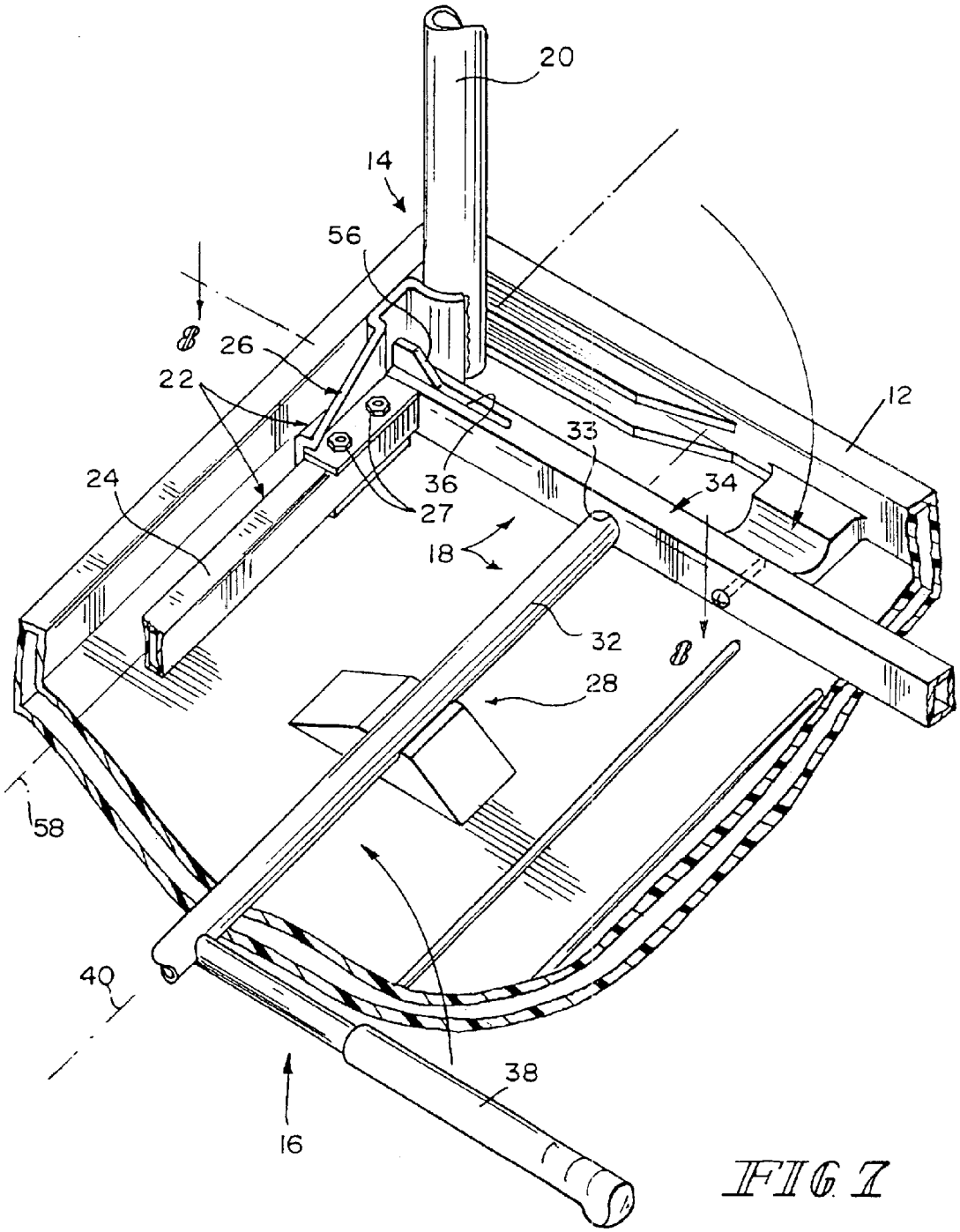
FIG. 7 is a perspective view of a corner of the table, with portions broken away, showing the handle rotated to the leg-locking orientation to position the leg inwardly to lock the leg in the extended orientation.
Figure 8:
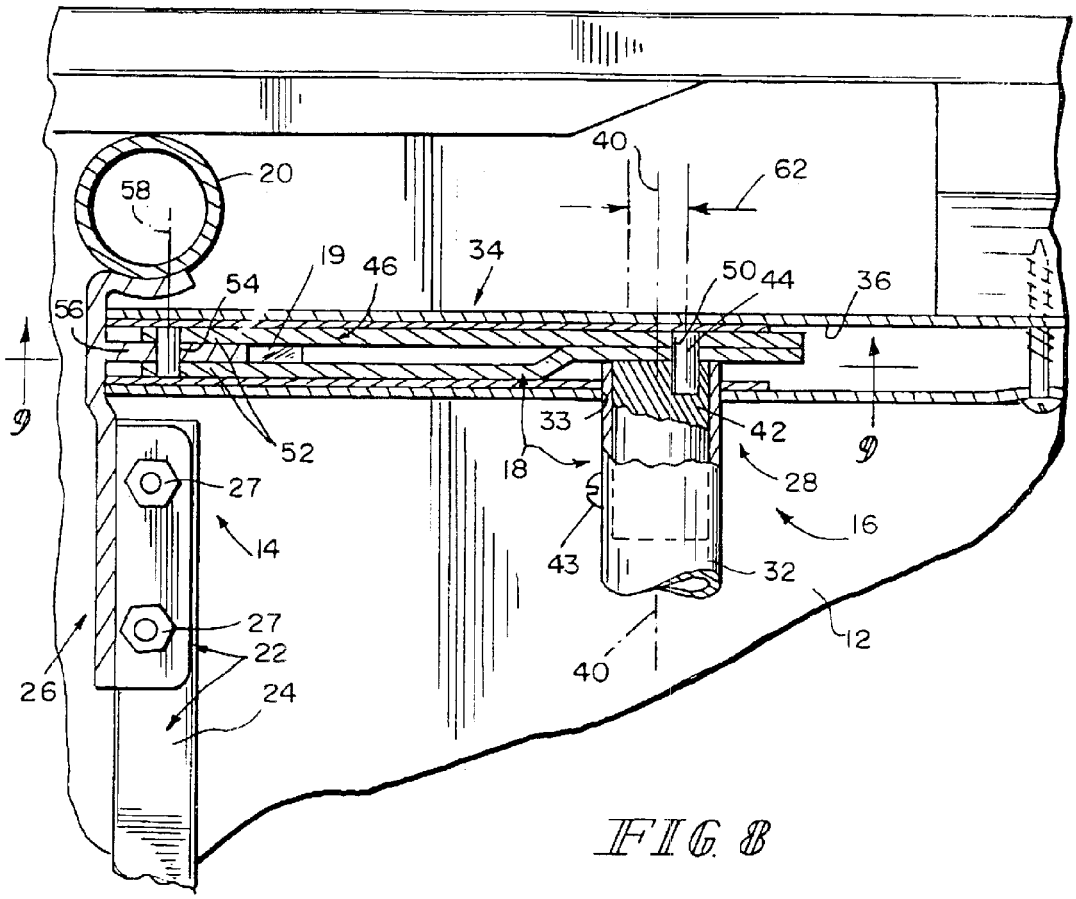
FIG. 8 is a sectional view taken along lines 8—8 of FIG. 7 showing the eccentric element rotated to an inward location to retract the slide in the channel so that the tongue of the bracket engages the rotation blocker.
Figure 9:
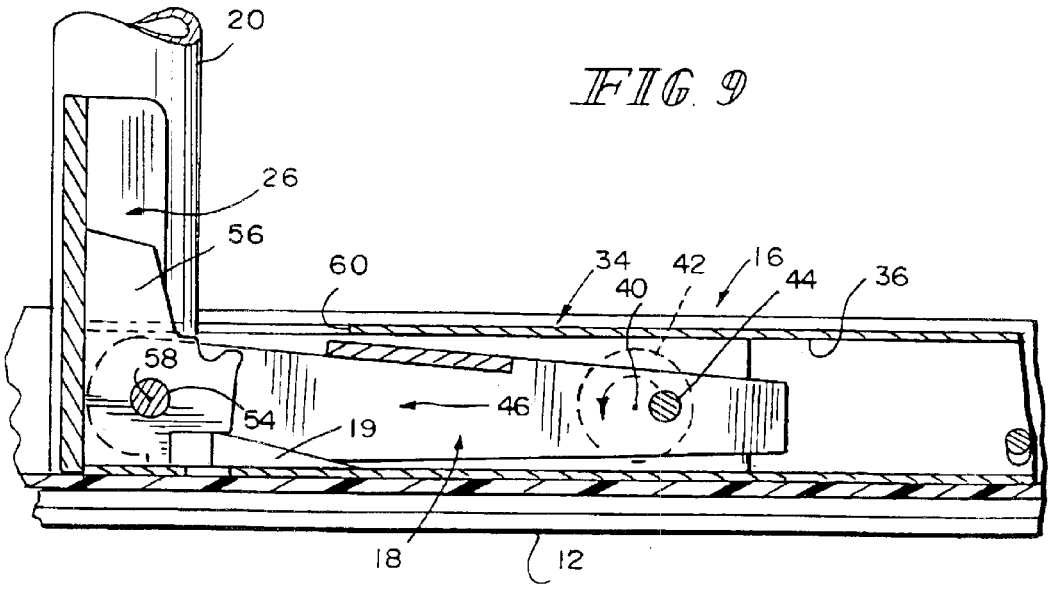
FIG. 9 is a sectional view taken along lines 9—9 of FIG. 8 showing the tongue engaging the rotation blocker when the leg is oriented in the extended orientation.

To lock the leg 14 in the extended orientation, the adjustment device 18 moves to its leg-locking orientation to move a tongue 56 of each bracket 26 inwardly against a rotation blocker 19, as shown in FIGS. 7–9. In this condition, the rotation blocker 19 blocks rotation of the leg 14 from the extended orientation to the collapsed orientation.

Figure 10:
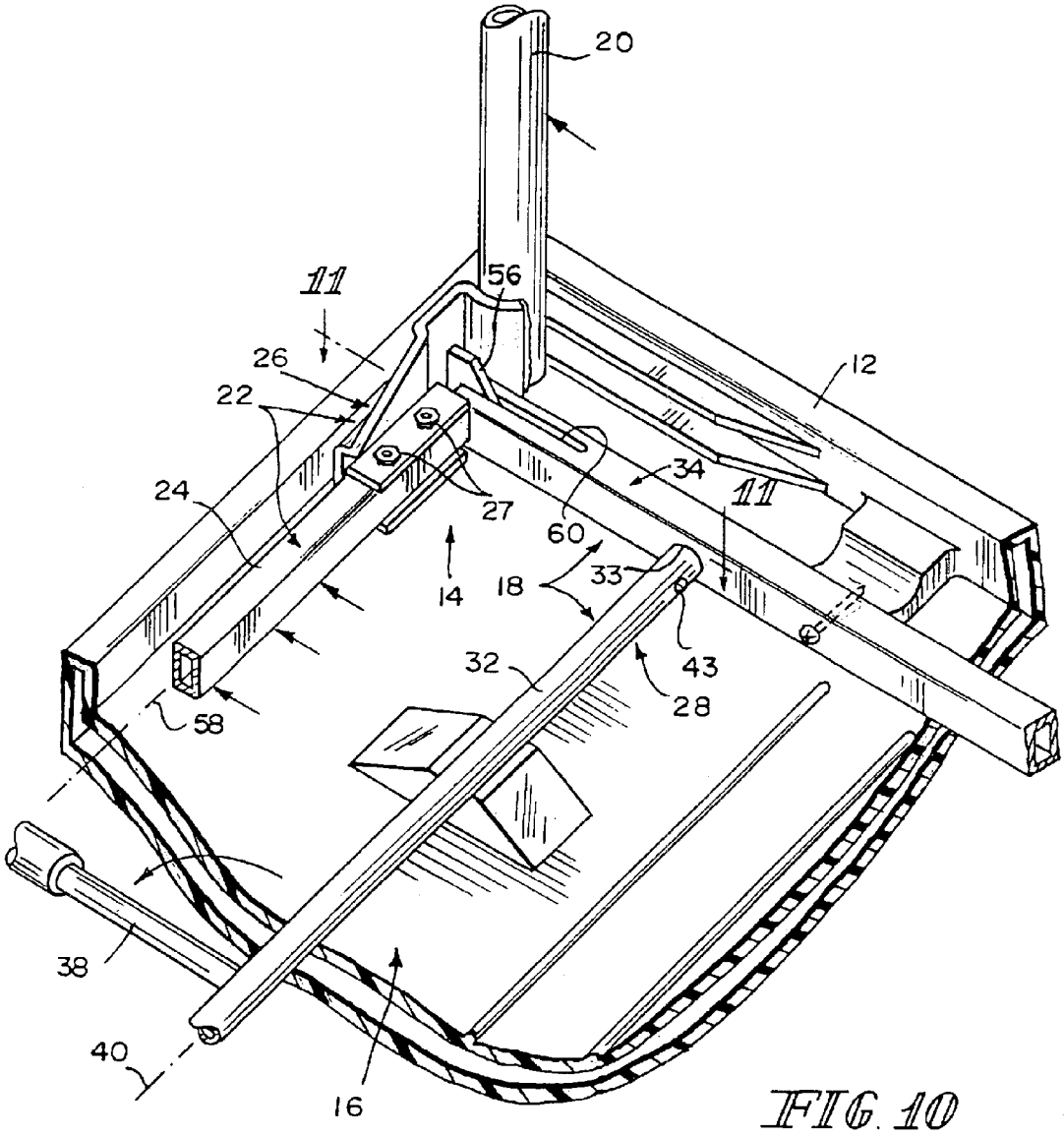
FIG. 10 is a perspective view similar to FIG. 7 showing the handle rotated to the leg-unlocking orientation to position the leg outwardly to unlock the leg for rotation to the collapsed orientation.
Figure 11:
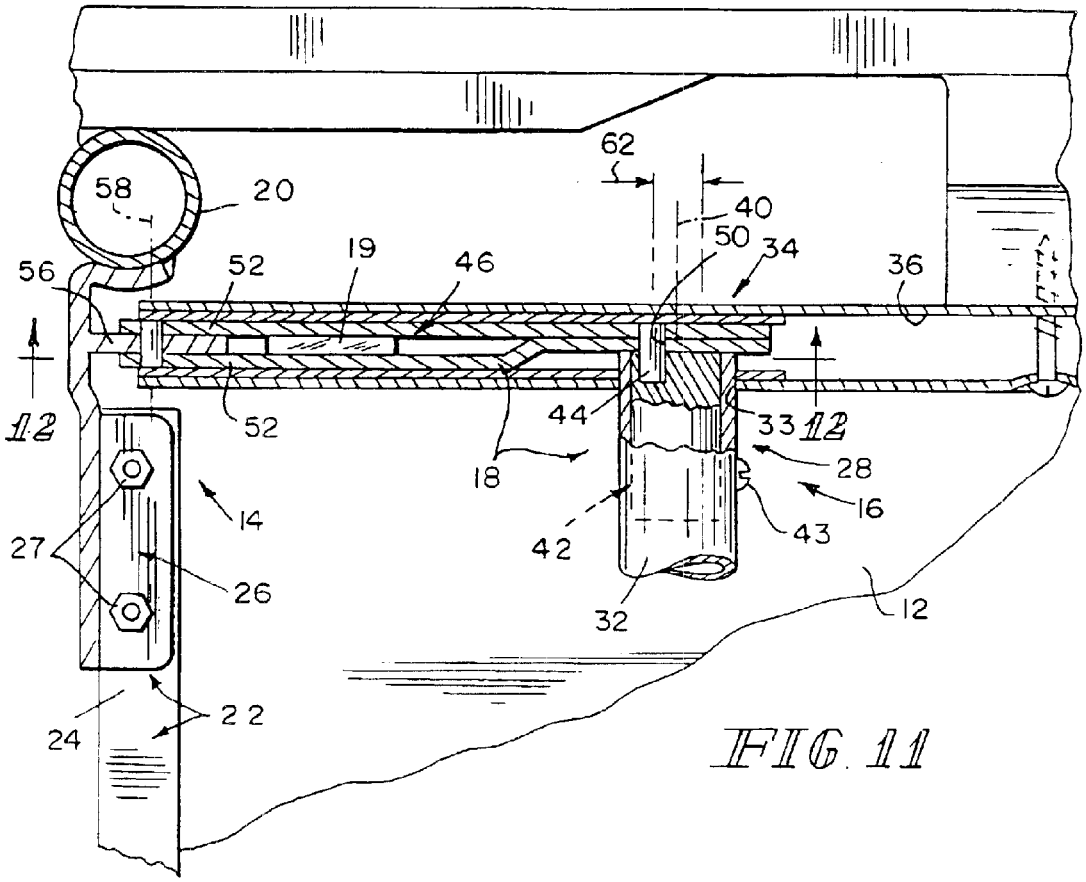
FIG. 11 is a sectional view taken along lines 11—11 of FIG. 10 showing the eccentric element rotated to an outward location to move the slide outwardly in the channel so that the tongue disengages the rotation blocker.
Figure 12:
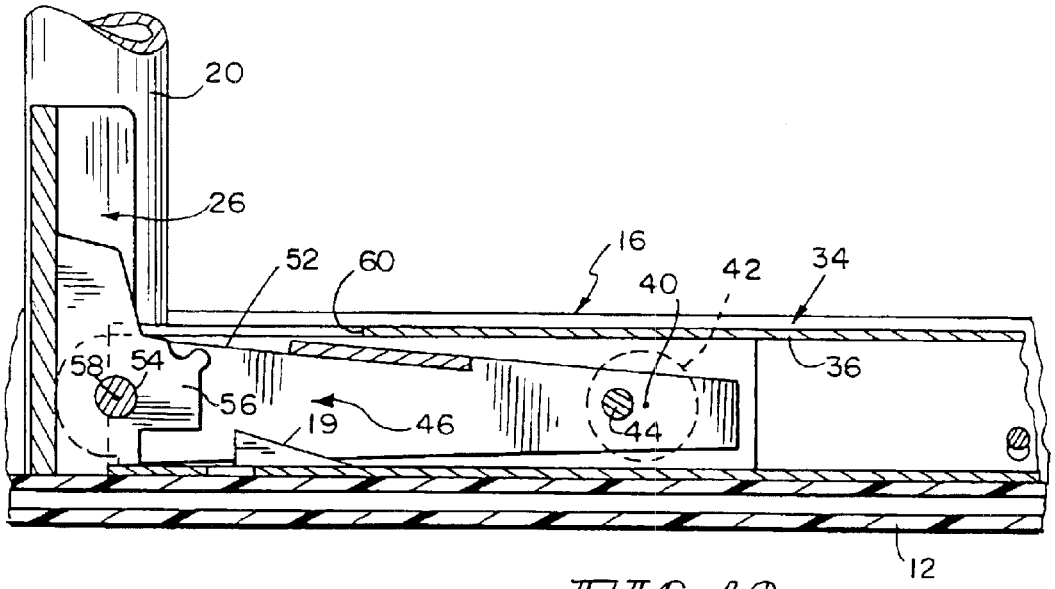
FIG. 12 is a sectional view taken along lines 12—12 of FIG. 11 showing the tongue disengaging the rotation blocker when the leg is oriented in the extended orientation.

To unlock the leg 14 for rotation from the extended orientation to the collapsed orientation, the adjustment device 18 is moved to its leg-unlocking orientation to move the tongue 56 outwardly away from the rotation blocker 19, as shown in FIGS. 10–12. In this condition, the leg 14 is allowed to rotate from the extended orientation to the collapsed orientation. The adjustment device 18 remains in the leg-unlocking orientation during rotation of the leg 14 from the extended orientation to the collapsed orientation, as suggested in FIGS. 13–15.

Figure 16:
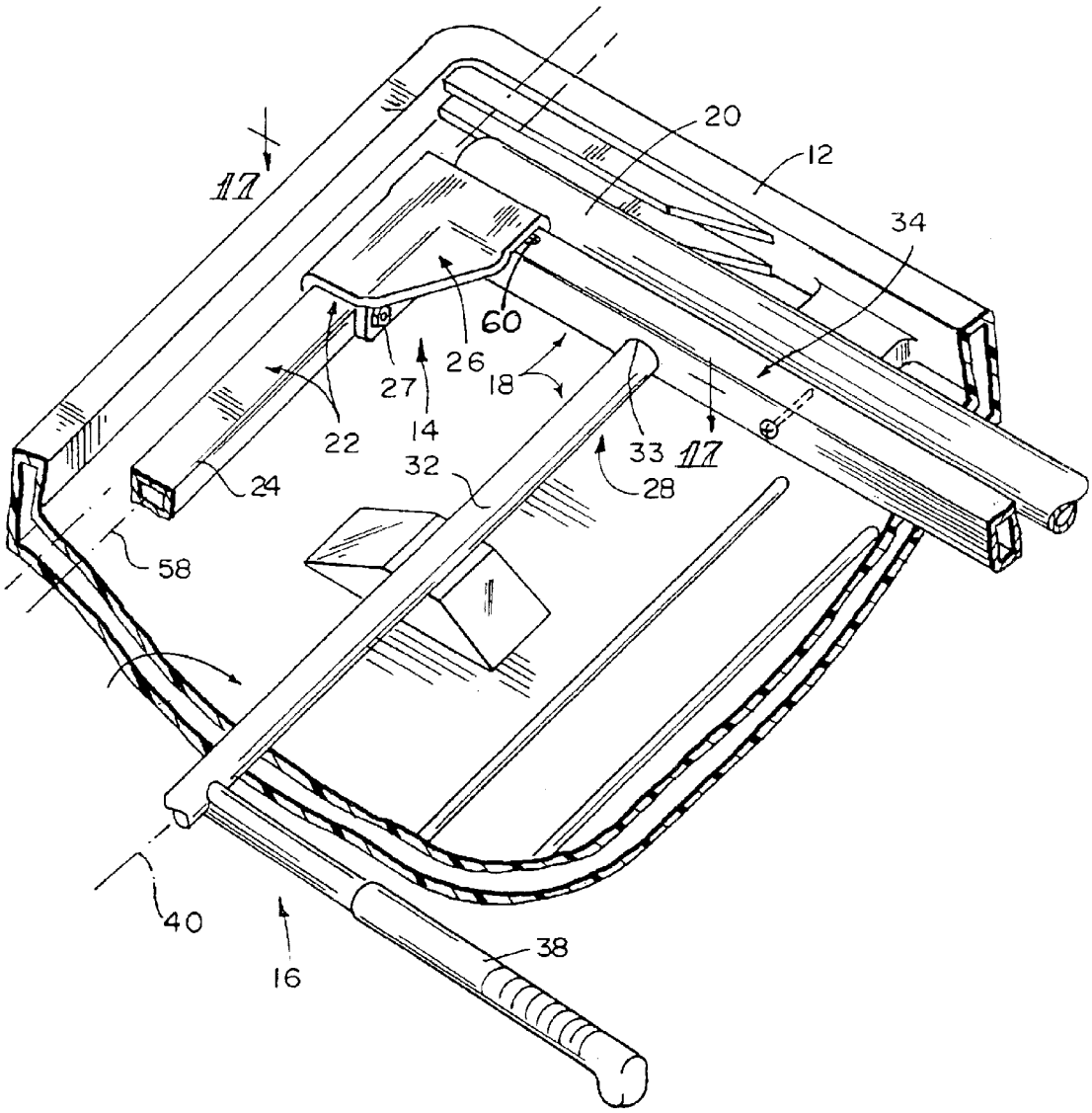
FIG. 16 is a perspective view similar to FIG. 13 showing the handle rotated back to the leg-locking orientation to position the leg inwardly to lock the leg in the collapsed orientation.
Figure 17:
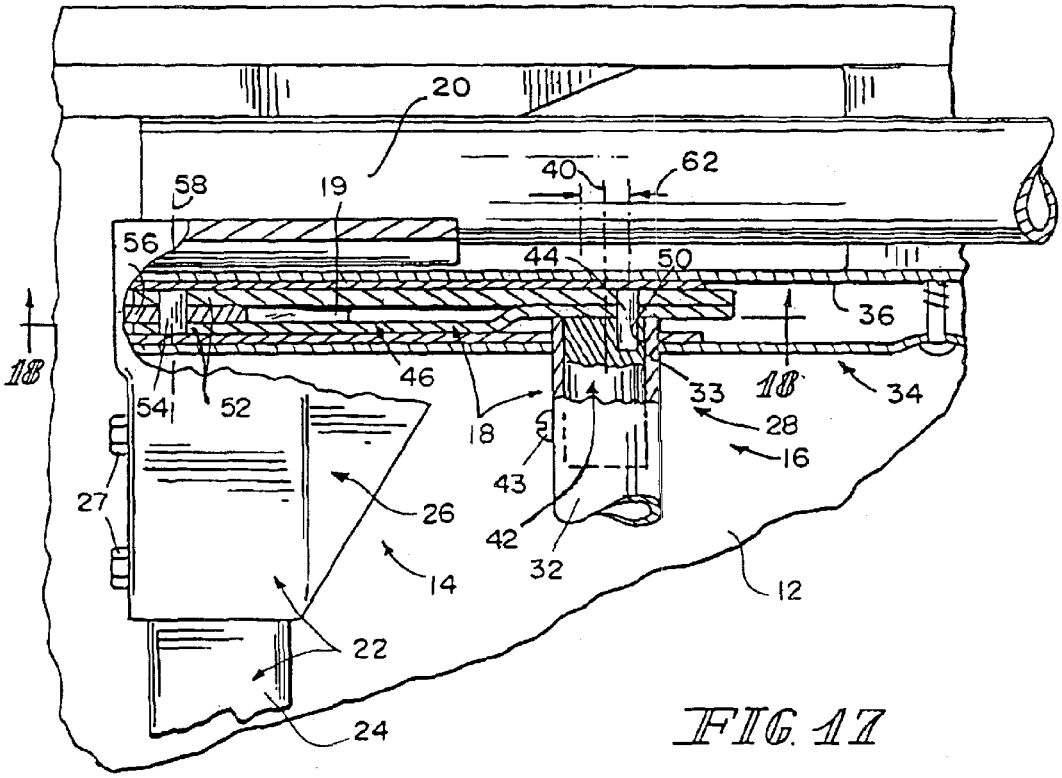
FIG. 17 is a sectional view taken along lines 17—17 of FIG. 16 showing the eccentric element rotated to its inward location to retract the slide in the channel to position the tongue against the rotation blocker to lock the leg in the collapsed orientation.
Figure 18:
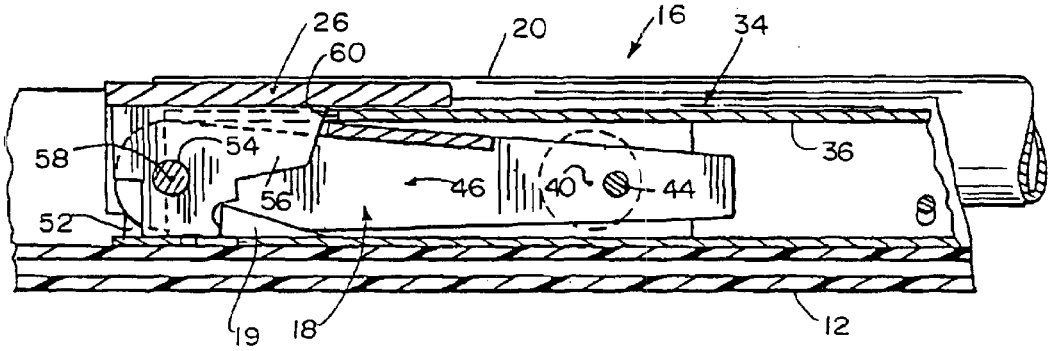
FIG. 18 is a sectional view taken along lines 18—18 of FIG. 17 showing the tongue engaging the rotation blocker when the leg is oriented in the collapsed orientation.

To lock the leg 14 in the collapsed orientation, the adjustment device 18 is moved back to its leg-locking orientation to move the tongue 56 inwardly against the rotation blocker, as shown in FIGS. 16–18. In this condition, the rotation blocker 19 blocks rotation of the leg 14 from the collapsed orientation to the extended orientation.

The adjustment device 18 includes a rotatable leg actuator 28, as shown in FIG. 6, to be operated by a user of the table 10 to move the leg 14 relative to the rotation blockers 19. The leg actuator 28 includes an actuator shaft 32 including opposite ends. Each end extends through an aperture 33 formed in a frame member 34 into the channel 36 thereof. A handle 38 included in the leg actuator 28 is coupled to the actuator shaft 32 for rotation thereof about a rotation axis 40 extending through the shaft 32. A plug 42 included in the leg actuator 28 is inserted in each end of the shaft 32 and is coupled thereto by a fastener 43. Each plug 42 includes an eccentric element 44 positioned in eccentric relation to the shaft 32 for rotation about the rotation axis 40 upon rotation of the shaft 32 by the handle 38.

The adjustment device 18 includes a motion converter 30 associated with each eccentric element 44 and each bracket 26 to convert rotation of the leg actuator 28 into rectilinear motion of each bracket 26 and thus the leg 14, as shown in FIG. 6 with respect to one of the motion converters 30. The motion converter 30 includes a slide 46 positioned inside one of the channels 36 for rectilinear motion therein upon rotation of the actuator 28. The channel 36 may thus be considered as a slide guide included in the motion converter 30.

Opposite ends of the slide 46 are coupled to the eccentric element 44 and the tongue 56 of each bracket 26. One end of the slide 46 is formed to include an element-receiving aperture 50, as shown in FIG. 6. The eccentric element 44 extends into the aperture 50 for movement therein to drive the slide 46 back and forth inside the channel 36. The other end of the slide 46 includes a pair of ears 52 and an axle 54 mounted to the ears 52. The tongue 56 extends through a slot 60 formed in the frame member 34 and is coupled to the axle 54. The axle 54 establishes a rotation axis 58 about which the leg 14 rotates between the extended and collapsed orientations. The rotation axis 58 is parallel to the rotation axis 40.

The slide 46 is tapered between its ends, as shown in FIG. 6. In particular, the end formed to include the aperture 50 is smaller than the end including the ears 52 and axle 54 to accommodate rotation of the eccentric element 44 about the axis 40 inside the channel 36.

The components of the adjustment device 18 are shown in the leg-locking orientation in FIGS. 7–9 and 16–18. In particular, the handle 38 is rotated inwardly, as shown in FIGS. 7 and 16, to rotate the eccentric element 44 to an inward location, as shown in FIGS. 8, 9, 17, and 18. When rotated to the inward location, the eccentric element 44 retracts the slide 46 in the channel 36 a distance 62, as shown in FIGS. 8 and 17, to cause rotation-blocking engagement between the tongue 56 and the rotation blocker 19 to lock the leg 14 in the extended orientation when the leg 14 is oriented in the extended orientation, as shown in FIGS. 7–9, and to lock the leg 14 in the collapsed orientation when the leg 14 is oriented in the collapsed orientation, as shown in FIGS. 16–18.

Figure 13:
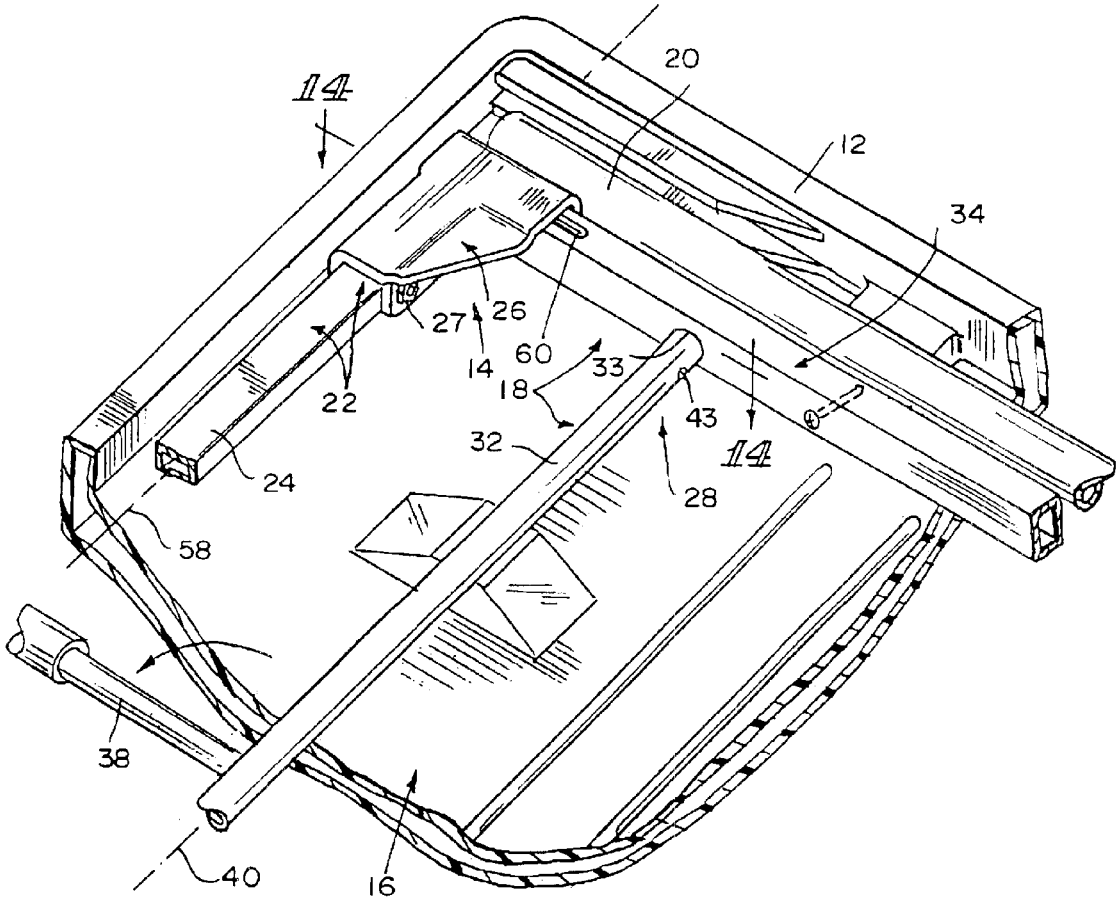
FIG. 13 is a perspective view similar to FIG. 10 showing the handle in the leg-unlocking orientation and the leg rotated to the collapsed orientation.
Figure 14:
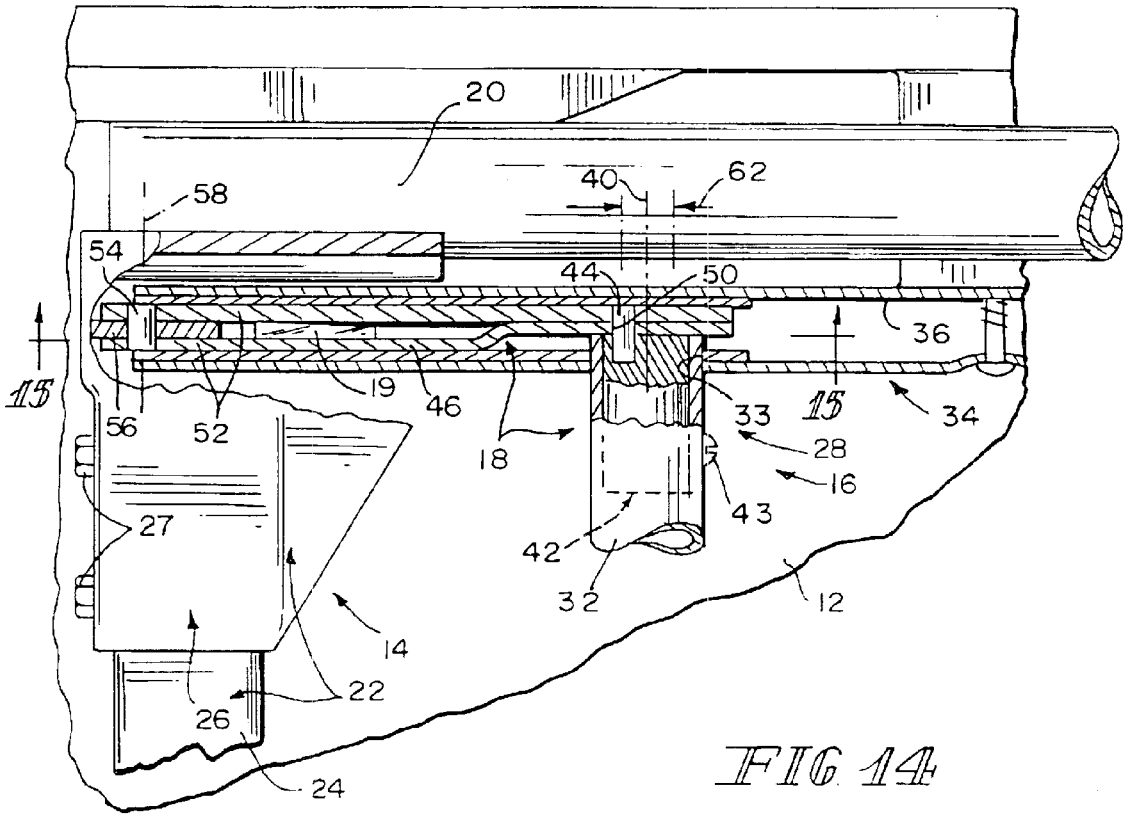
FIG. 14 is a sectional view taken along lines 14—14 of FIG. 13.
Figure 15:
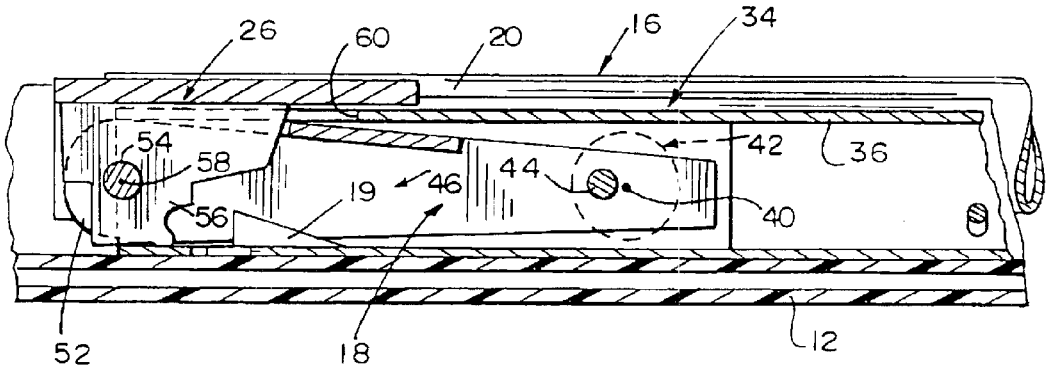
FIG. 15 is a sectional view taken along lines 15—15 of FIG. 14 showing the tongue disengaging the rotation blocker when the leg is oriented in the collapsed orientation.

The components of the adjustment device 18 are shown in the leg-unlocking orientation in FIGS. 10–15. In particular, the handle 38 is rotated outwardly, as shown in FIGS. 10 and 13, to rotate the eccentric element 44 to an outward location, as shown in FIGS. 11, 12, 14, and 15. When rotated to the outward location, the eccentric element 44 extends the slide 46 in the channel 136 the distance 62, as shown in FIGS. 11 and 14, to allow rotation of the leg 14 from the extended orientation, as shown in FIGS. 10–12, to the collapsed orientation, as shown in FIGS. 13–15.

Figure 19:
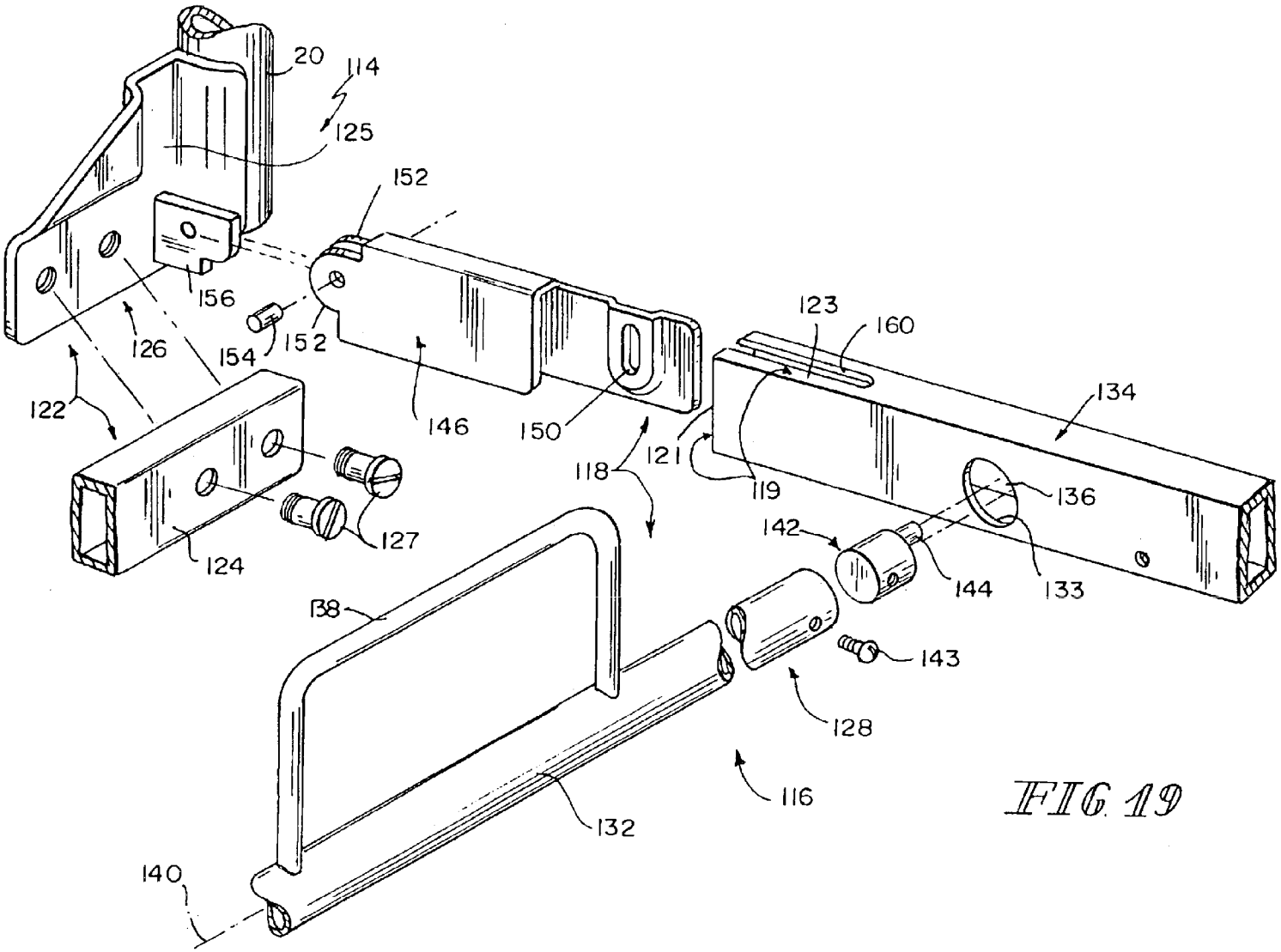
FIG. 19 is an exploded perspective view, with portions broken away, showing another embodiment of a leg (on left side of page) and leg lock (to the right of the leg) for use with the table of FIG. 1, the leg including a leg member and a leg member support including a bracket coupled to the leg member and a rotatable support shaft to be coupled to the bracket, the leg lock including a slide to be coupled to the bracket and to be positioned inside a channel of a frame member of the table, a rotation blocker provided by an end surface and outer surface of the frame member for engagement with the bracket to lock the leg in the extended and collapsed orientation, and a rotatable actuator including a rotatable actuator shaft, a handle coupled to the actuator shaft, and an eccentric element to extend inside the channel for engagement with the slide to move the slide back and forth in the channel to move the bracket relative to the rotation blocker in response to rotation of the actuator shaft by the handle.

Another leg 114 and another leg lock 116 for use with table 10 in place of legs 14 and leg locks 16 are shown in FIG. 19. The leg 114 is arranged to rotate relative to the table top 12 between an extended orientation, as shown in FIGS. 20–25 with respect to a portion of one leg 114, and a collapsed orientation, as shown in FIGS. 26–31 with respect to the same portion of leg 114. The leg lock 116 is used to lock the leg 114 in the extended and collapsed orientations.

Each leg 114 includes a pair of leg members 120 and a leg member support 122 arranged to support the leg members 120 for rotation between the extended and collapsed orientations, as shown in FIG. 19. The leg member support 122 includes a support shaft 124 and a pair of brackets 126 coupled to the support shaft 124 by fasteners 127 and welded to the leg members 120, as shown in FIG. 19 with respect to one leg member 122 and one bracket 126.

Figure 20:
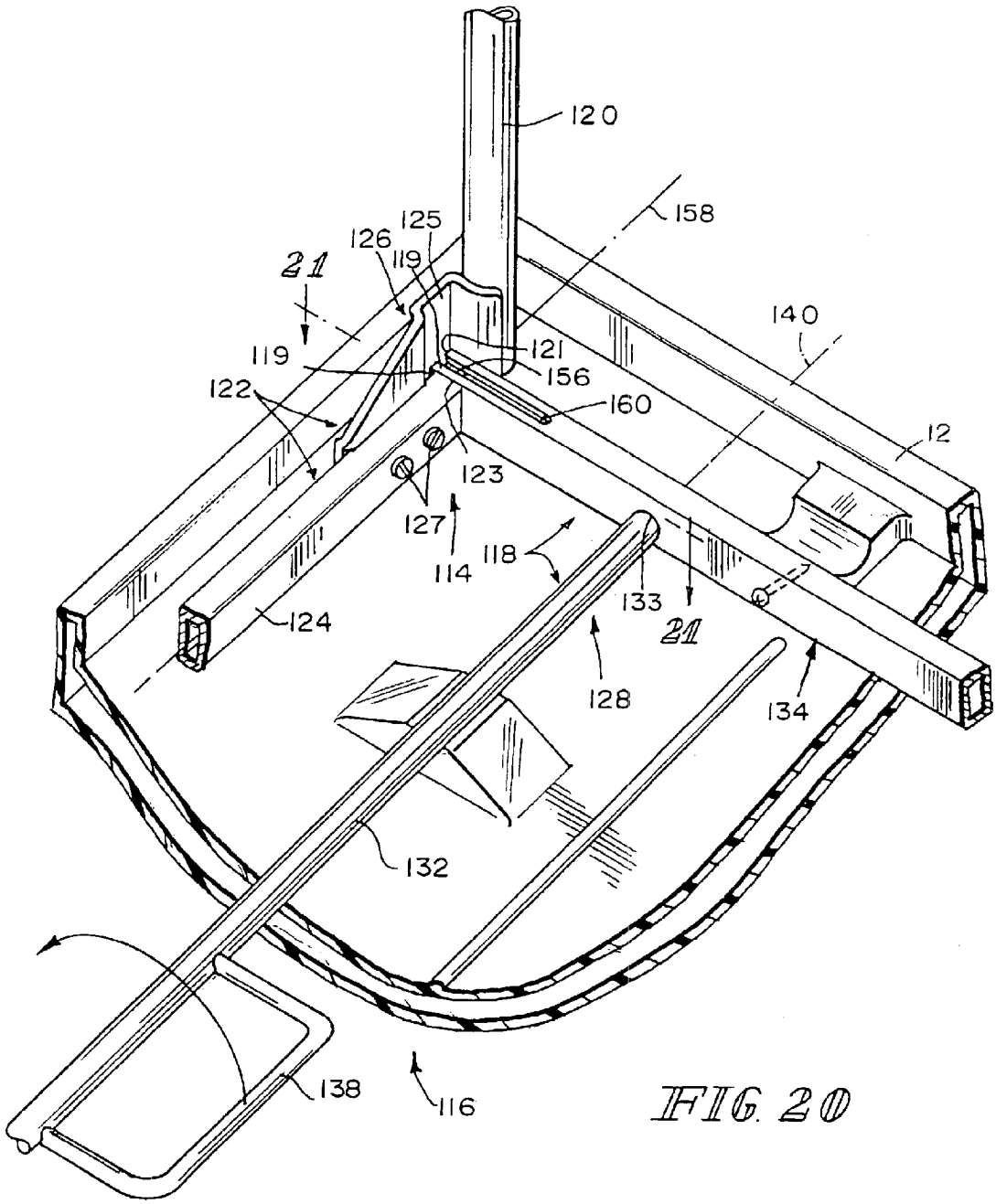
FIG. 20 is a perspective view of a corner of the table, with portions broken away, showing the handle of FIG. 19 rotated to a leg-locking orientation to position a leg inwardly to lock the leg in the extended orientation.
Figure 21:
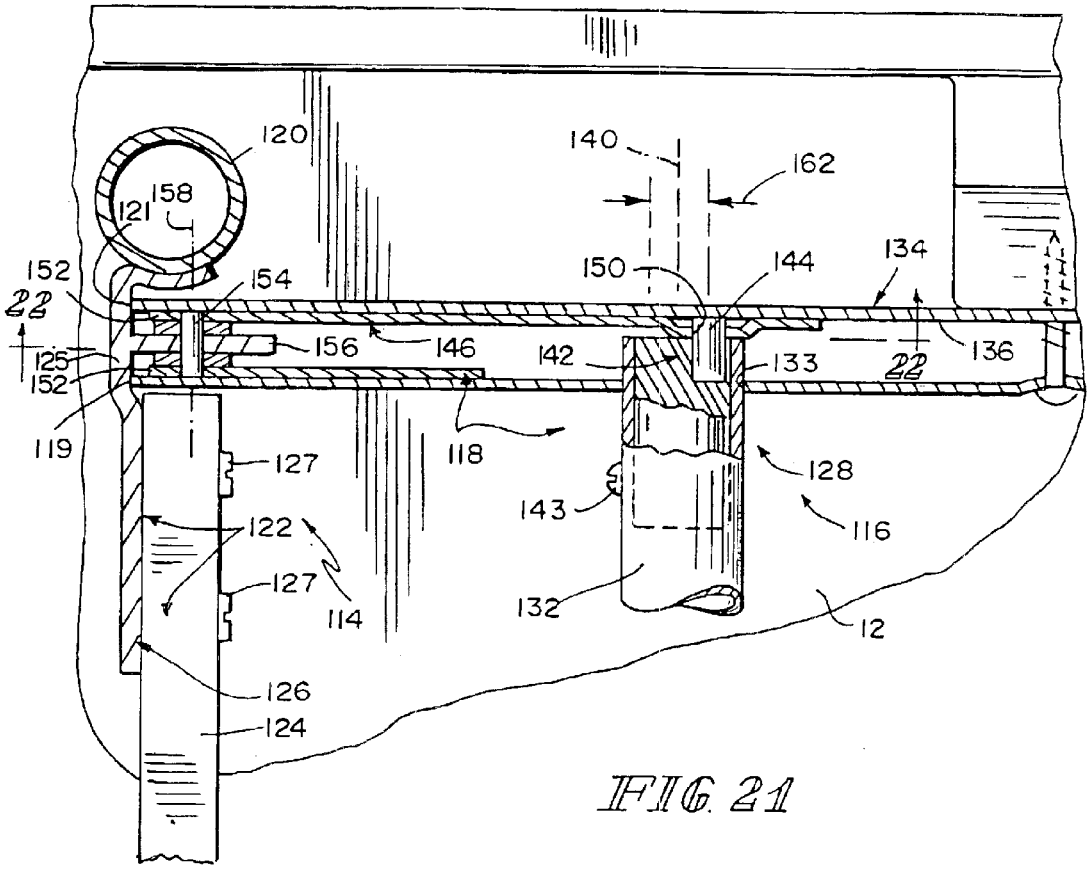
FIG. 21 is a sectional view taken along lines 21—21 of FIG. 20 showing an eccentric element rotated to an inward location to retract the slide in the channel to move a plate of the bracket against an end surface of the frame member to block rotation of the leg to lock the leg in the extended orientation.
Figure 22:
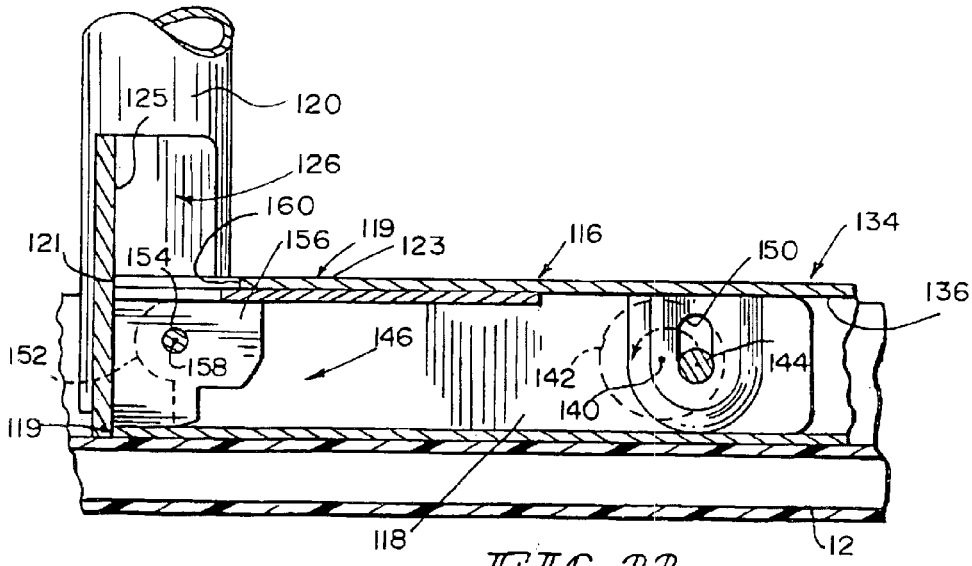
FIG. 22 is a sectional view taken along lines 22—22 of FIG. 21 showing the plate engaging the end surface of the frame member to lock the leg in the extended orientation.

The leg lock 116 includes an adjustment device 118 arranged to move the leg 114 relative to a rotation blocker 119 associated with each bracket 126, as shown in FIG. 19. The adjustment device 118 is arranged to move between a leg-locking orientation to lock the leg 114 in the extended orientation when the leg 114 is oriented in the extended orientation, as shown in FIGS. 20–22, and to lock the leg 114 in the collapsed orientation when the leg 114 is oriented in the collapsed orientation, as shown in FIGS. 29–31, and a leg-unlocking orientation to allow rotation of the leg 114 between the extended and collapsed orientations, as shown in FIGS. 23–28.

Each rotation blocker 119 is provided by one of two elongated, hollow frame members 134 which cooperate to provide a frame for the table top 12. In particular, the rotation blocker 119 includes end and outer surfaces 121, 123 of the frame member 134, as shown in FIG. 19 with respect to one rotation blocker 119.

Figure 29:
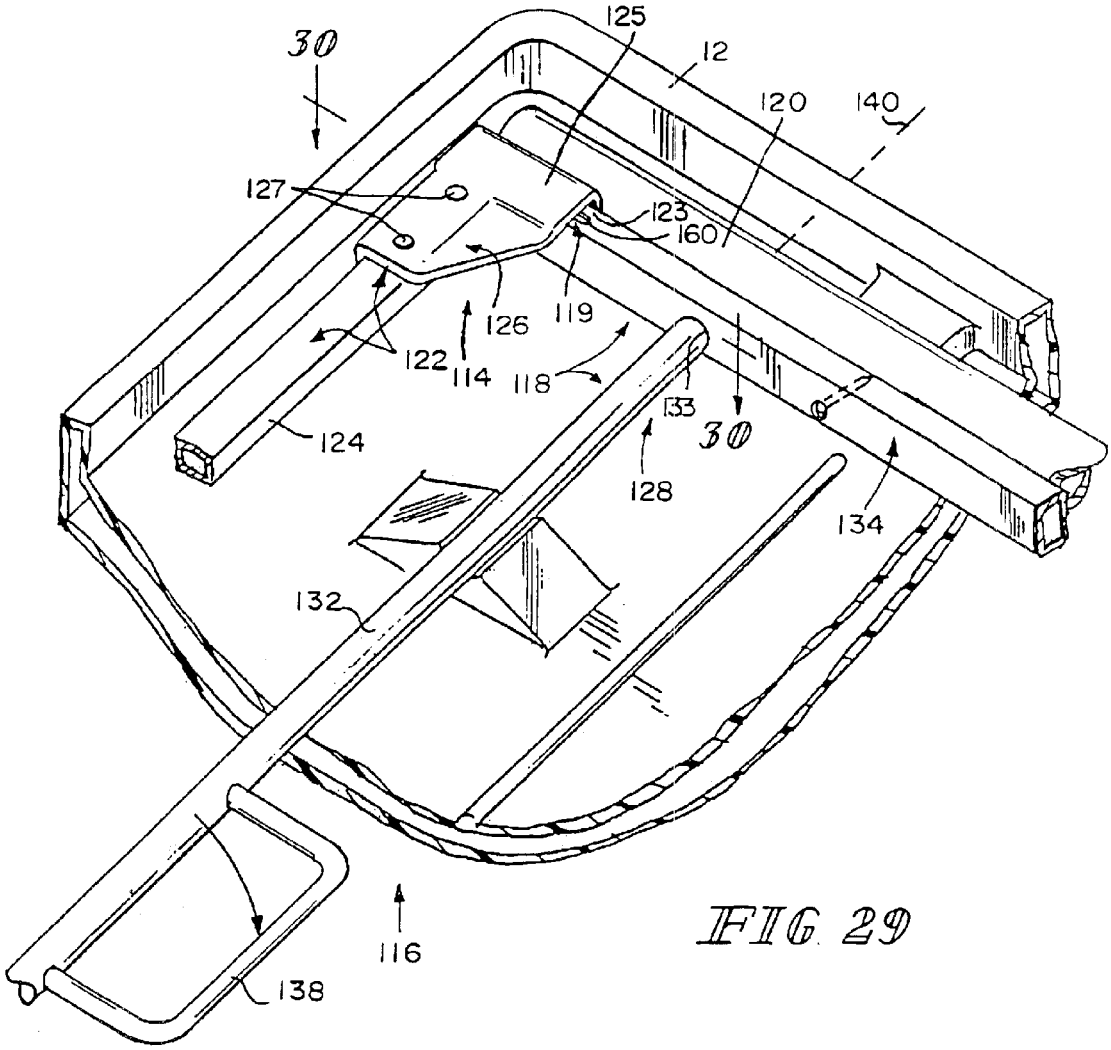
FIG. 29 is a perspective view similar to FIG. 26 showing the handle rotated inwardly back to the leg-locking orientation to lock the leg in the collapsed orientation.
Figure 30:
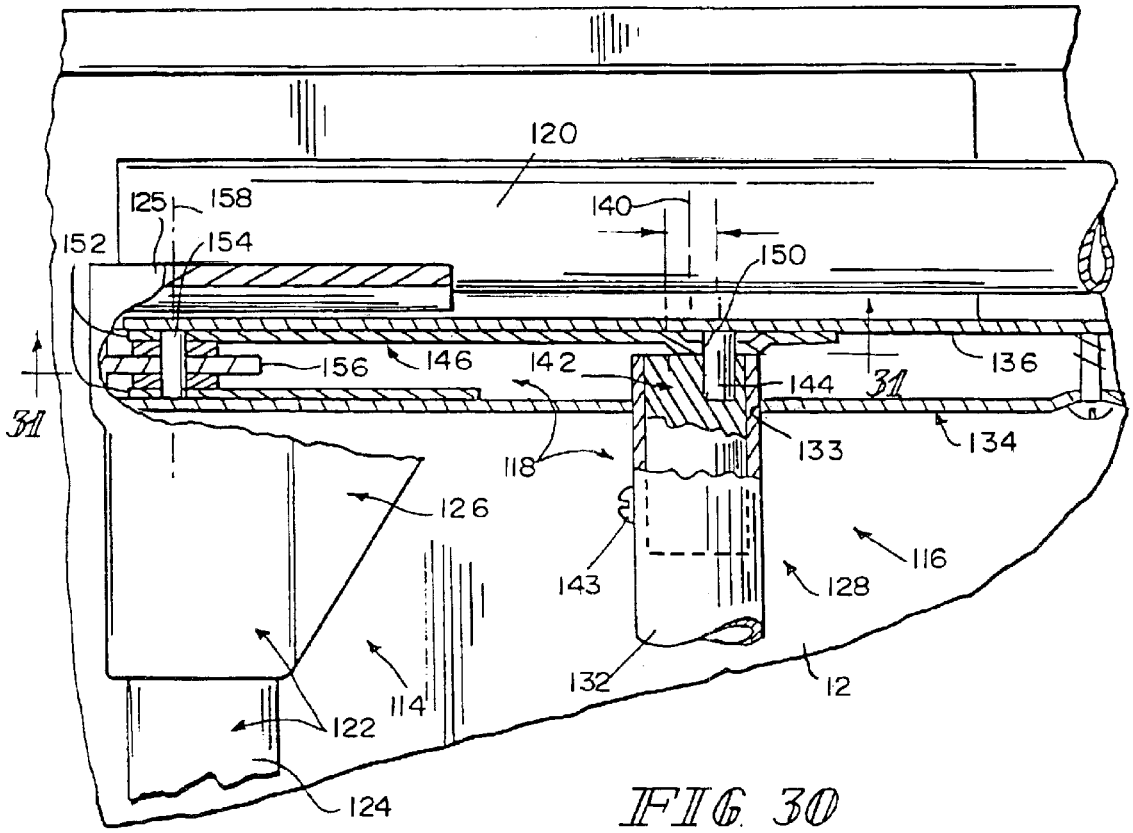
FIG. 30 is a sectional view taken along lines 30—30 showing the eccentric element rotated back to its inward location to retract the slide in the channel to lock the leg in the collapsed orientation.
Figure 31:
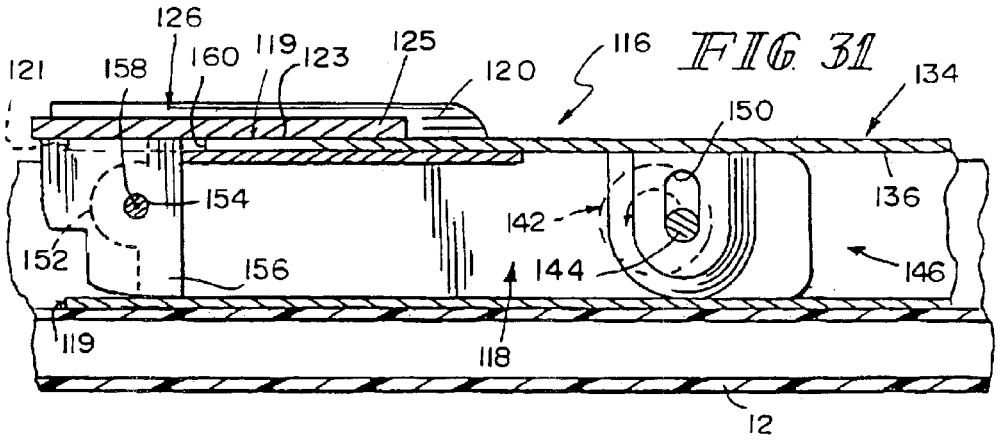
FIG. 31 is a sectional view taken along lines 31—31 showing the plate engaging the outer surface of the frame member to block rotation of the leg from the collapsed orientation to the extended orientation to lock the leg in the collapsed orientation.

Once the leg 114 is rotated to assume the collapsed orientation, the adjustment device 118 may be moved to its leg-locking orientation to move the leg 114 inwardly to lock the leg 114 in the collapsed orientation, as shown in FIGS. 29–31. In this condition, the plate 125 engages the outer surface 123 so that the outer surface 123 blocks rotation of the leg 114 from the collapsed orientation to the extended orientation.

The adjustment device 118 includes a rotatable leg actuator 128, as shown in FIG. 19, to be operated by a user of the table 10 to move the adjustment device 118 between its leg-locking and leg-unlocking orientations. The leg actuator 128 includes an actuator shaft 132 including opposite ends. Each end extends through an aperture 133 formed in one of the frame members 34 into a channel 136 provided by an inner surface of the frame member 134. A handle 138 included in the leg actuator 128 is coupled to the actuator shaft 132 for rotation thereof about a rotation axis 140 extending through the shaft 132. A plug 142 included in the leg actuator 128 is inserted in each end of the shaft 132 and is coupled thereto by a fastener 143. Each plug 142 includes an eccentric element 144 positioned in eccentric relation to the shaft 132 for rotation about the rotation axis 140 upon rotation of the shaft 132 by the handle 138.

The adjustment device 118 includes a motion converter 130 associated with each eccentric element 144 and each bracket 126 to convert rotation of the leg actuator 128 into rectilinear motion of each bracket 126 and thus the leg 114, as shown in FIG. 19 with respect to one of the motion converters 130. The motion converter 130 includes a slide 146 positioned inside one of the channels 136 for rectilinear motion therein upon rotation of the actuator 128. The channel 136 may thus be considered as a slide guide included in the motion converter 130.

Opposite ends of the slide 146 are coupled to the eccentric element 144 and a tongue 156 of the bracket 126. One end of the slide 146 is formed to include an elongated element-receiving aperture 150, as shown in FIG. 19. The eccentric element 144 extends into the aperture 150 for movement therein to drive the slide 146 back and forth inside the channel 136. The other end of the slide 146 includes a pair of ears 152 and an axle 154 mounted to the ears 152. The tongue 156 of the bracket 126 is coupled to the axle 154 which establishes a rotation axis 158 about which the leg 114 rotates between the extended and collapsed orientations. The rotation axis 158 is parallel to the rotation axis 140.

The frame member 134 is formed to include a tongue-receiving slot 160, as shown in FIG. 19. The slot 160 extends from the end surface 121 and through the outer surface 123. The tongue 156 extends through the slot 160 when the leg 114 is oriented in the collapsed orientation and moves therethrough upon movement of the adjustment device 118 between the leg-locking and leg-unlocking orientations.

The components of the adjustment device 118 are shown in the leg-locking orientation in FIGS. 20–22 and 29–31. In particular, the handle 138 is rotated inwardly, as shown in FIGS. 20 and 29, to rotate the eccentric element 144 to an inward location, as shown in FIGS. 21, 22, 30, and 31. When rotated to the inward location, the eccentric element 144 retracts the slide 146 a distance 162 in the channel 136, as shown in FIG. 21, to cause rotation-blocking engagement between the plate 125 and the end surface 121 when the leg 114 is oriented in the extended orientation, as shown in FIGS. 20–22, and between the plate 125 and the outer surface 123 when the leg 114 is oriented in the collapsed orientation, as shown in FIGS. 29–31.

Figure 23:
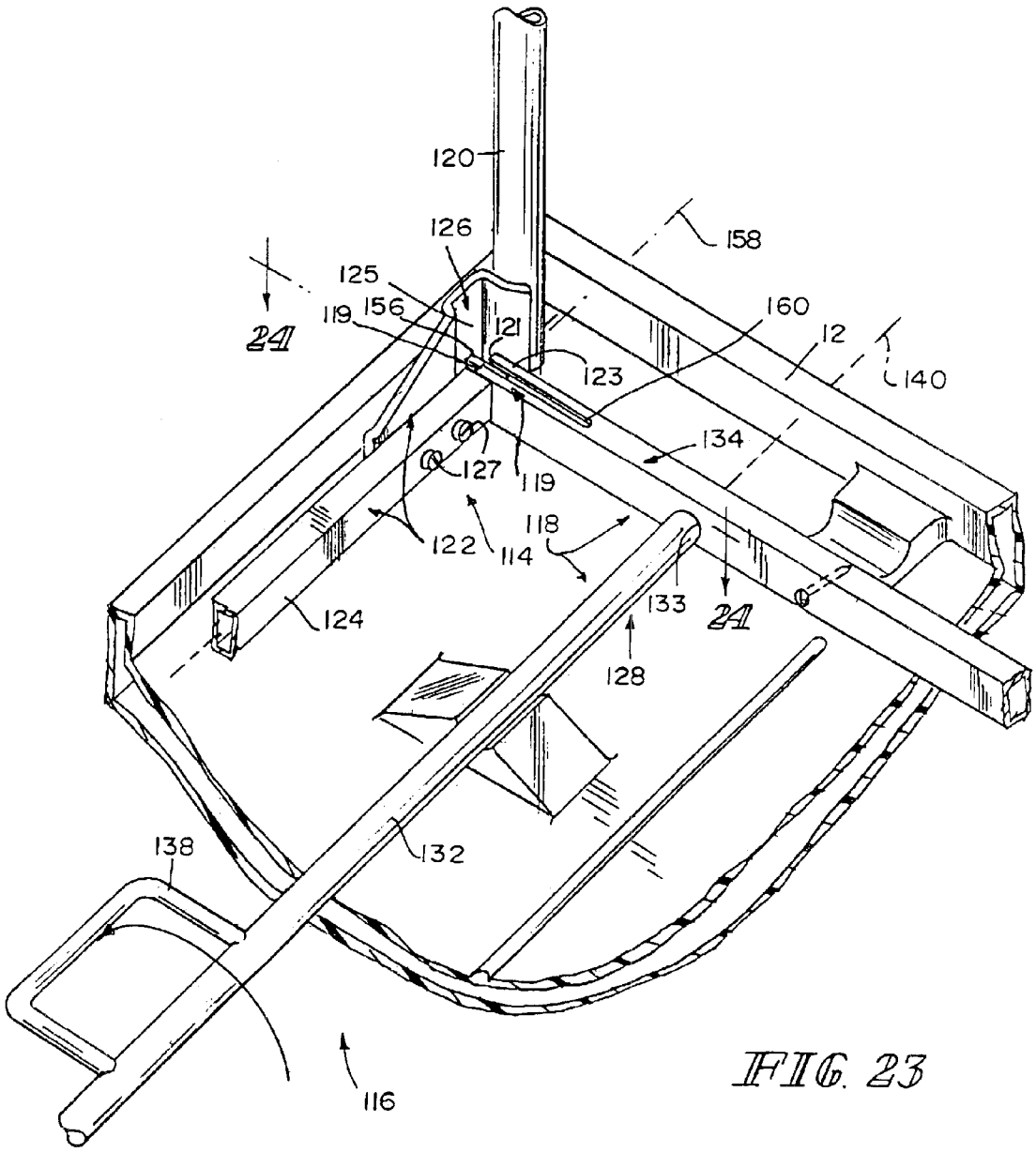
FIG. 23 is a perspective view similar to FIG. 20 showing the handle rotated to a leg-unlocking orientation to position the leg outwardly to unlock the leg in the extended orientation to allow rotation of the leg to the collapsed orientation.
Figure 24:
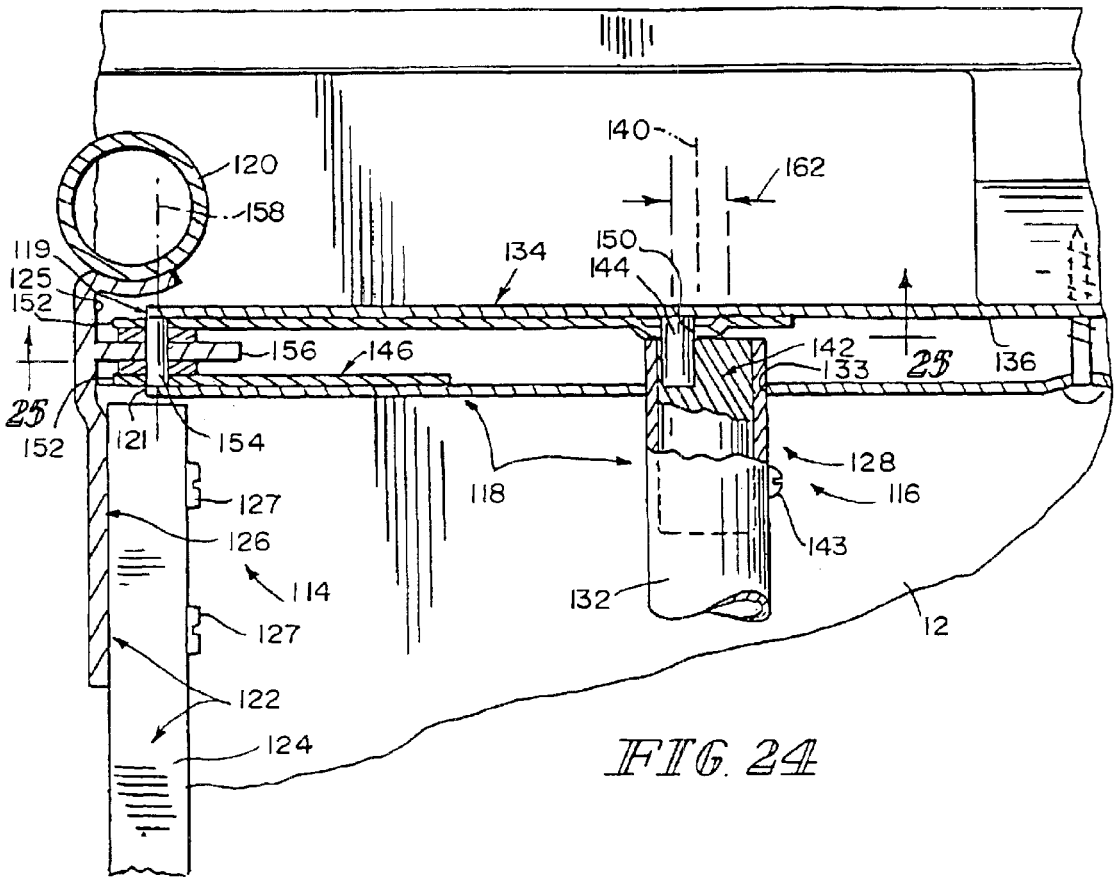
FIG. 24 is a sectional view taken along lines 24—24 of FIG. 23 showing the eccentric element rotated to an outward location to move the slide outwardly in the channel to move the plate away from the end surface of the frame member to allow rotation of the leg from the extended orientation to the collapsed orientation.
Figure 25:
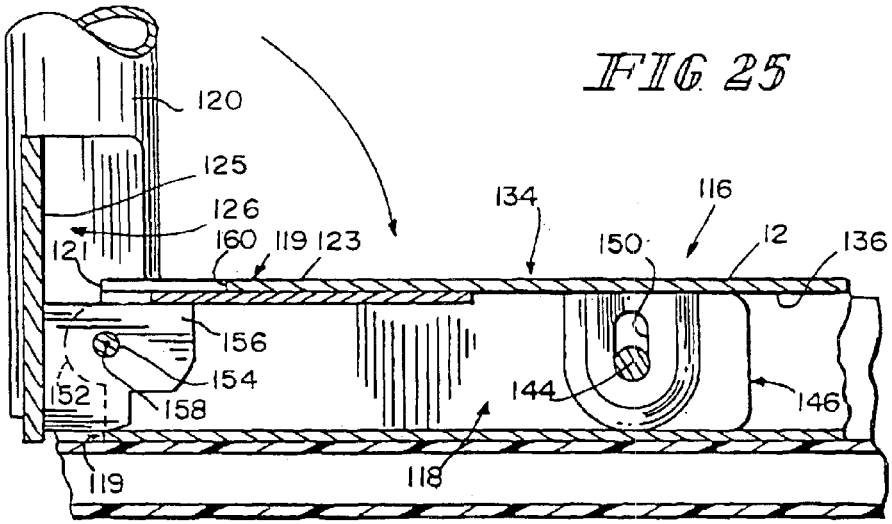
FIG. 25 is a sectional view taken along lines 25—25 of FIG. 24 showing the plate spaced apart from the end surface of the frame member to allow the leg to be collapsed.
Figure 26:
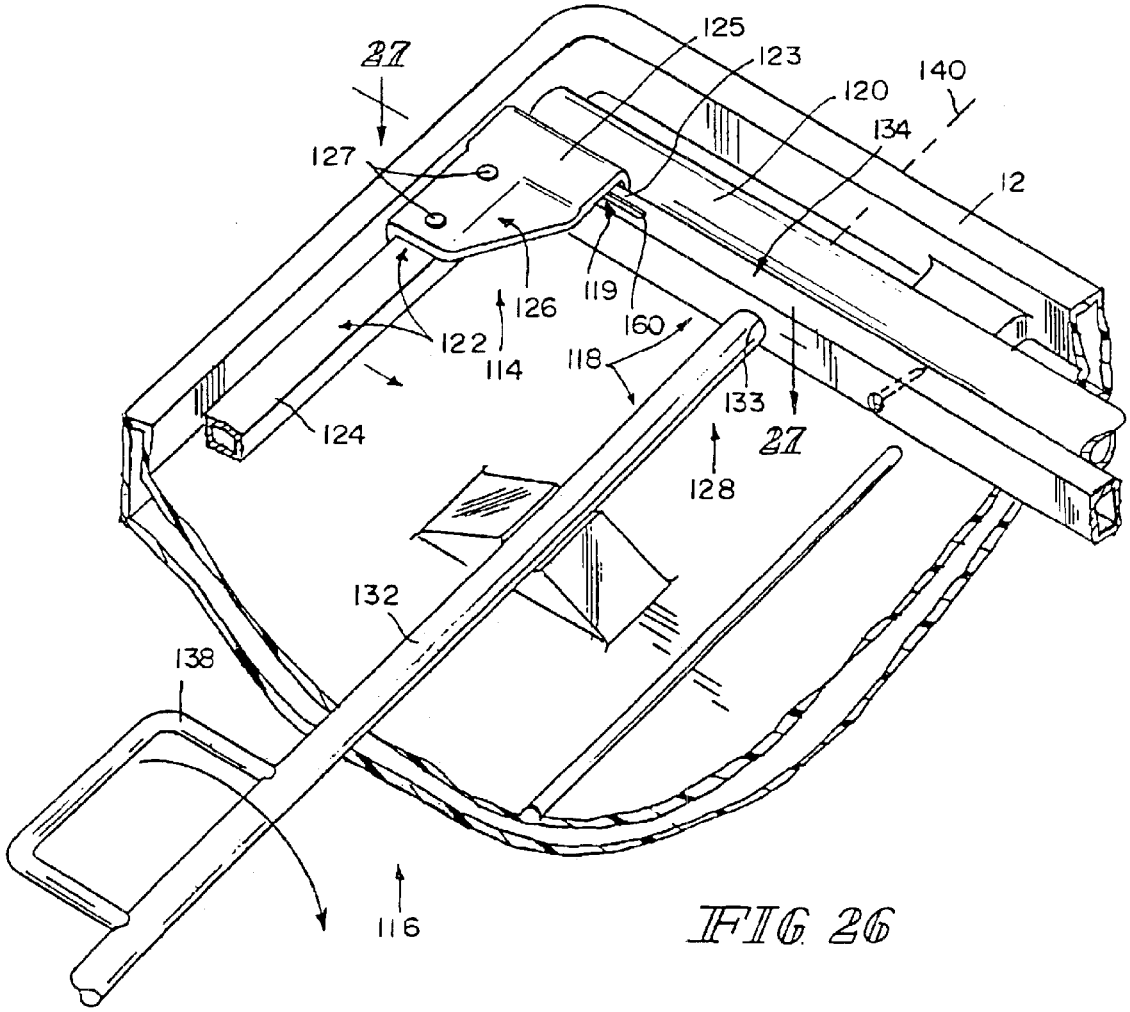
FIG. 26 is a perspective view similar to FIG. 23 showing the leg unlocked in the collapsed orientation.
Figure 27:
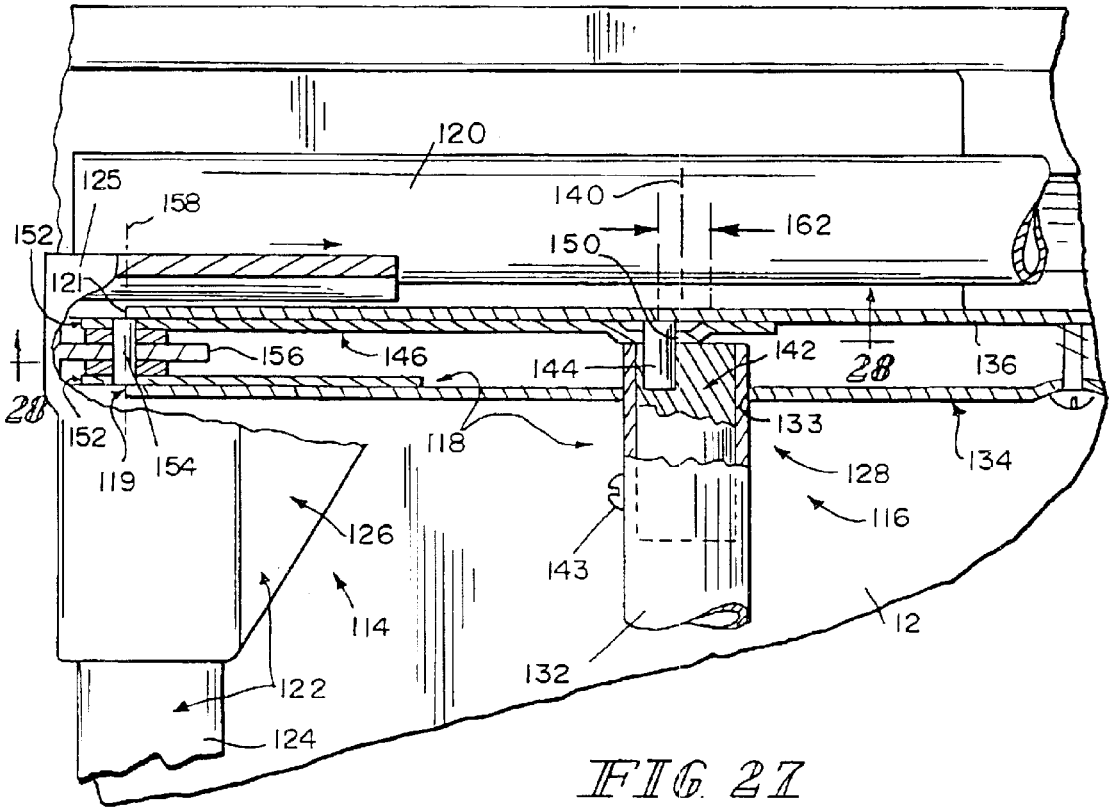
FIG. 27 is a sectional view taken along lines 27—27 of FIG. 26.
Figure 28:
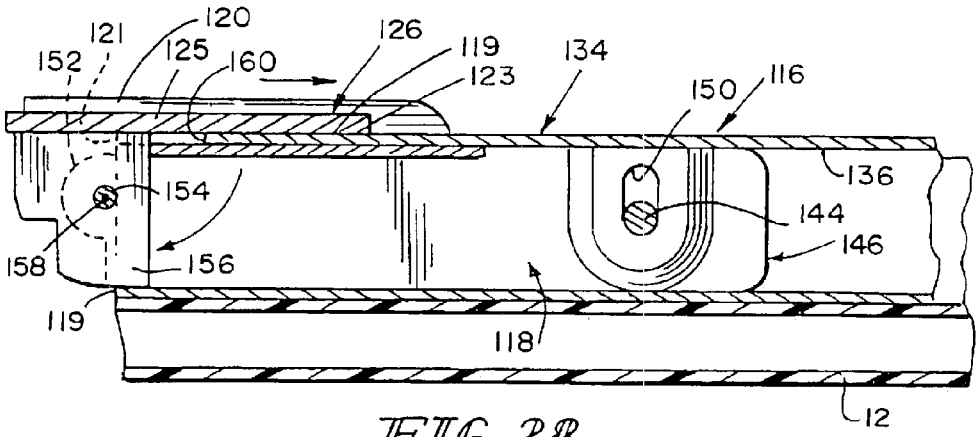
FIG. 28 is a sectional view taken along lines 28—28 of FIG. 27 showing the plate rotated to engage the outer surface of the frame member when the leg is unlocked in the collapsed orientation.

The components of the adjustment device 118 are shown in the leg-unlocking orientation in FIGS. 23–28. In particular, the handle 138 is rotated outwardly, as shown in FIGS. 23 and 26, to rotate the eccentric element 144 to an outward location, as shown in FIGS. 24, 25, 27, and 28. When rotated to the outward location, the eccentric element 144 extends the slide 146 the distance 162 in the channel 136, as shown in FIGS. 24 and 27, to allow rotation of the leg 114 from the extended orientation, as shown in FIGS. 23–25, to the collapsed orientation, as shown in FIGS. 26–28.

What is claimed is:

1. A table comprising a table top, a leg arranged to rotate relative to the table top between extended and collapsed orientations, and a leg lock including an adjustment device and a rotation blocker, the adjustment device being arranged to move rectilinearly between leg-locking and leg-unlocking orientations to move the leg relative to the rotation blocker, wherein, in the leg-locking orientation, the rotation blocker blocks rotation of the leg between the extended and collapsed orientations to lock the leg in the extended orientation when the leg is oriented in the extended orientation and to lock the leg in the collapsed orientation when the leg is oriented in the collapsed orientation and, in the leg-unlocking orientation, the leg is allowed to rotate between the extended and collapsed orientations.

2. The table of claim 1, wherein the adjustment device includes a rotatable leg actuator and a motion converter arranged to convert rotation of the leg actuator to rectilinear motion of the leg relative to the rotation blocker upon rotation of the leg actuator between the leg-locking and leg-unlocking orientations.

3. The table of claim 2, wherein the leg actuator is arranged to rotate about a first rotation axis and the leg is arranged to rotate about a second rotation axis spaced apart from and parallel to the first rotation axis.

4. A table comprising a table top, a leg arranged to rotate relative to the table top between extended and collapsed orientations, and a leg lock including an adjustment device and a rotation blocker, the adjustment device being arranged to move between leg-locking and leg-unlocking orientations to move the leg relative to the rotation blocker, wherein, in the leg-locking orientation, the rotation blocker blocks rotation of the leg between the extended and collapsed orientations to lock the leg in the extended orientation when the leg is oriented in the extended orientation and to lock the leg in the collapsed orientation when the leg is oriented in the collapsed orientation and, in the leg-unlocking orientation, the leg is allowed to rotate between the extended and collapsed orientations, wherein the adjustment device includes a rotatable leg actuator and a motion converter arranged to convert rotation of the leg actuator to rectilinear motion of the leg relative to the rotation blocker upon rotation of the leg actuator between the leg-locking and leg-unlocking orientations and wherein the leg actuator includes a rotatable actuator shaft and an eccentric element coupled to the actuator shaft in eccentric relation thereto for rotation therewith and the motion converter includes a slide guide and a slide coupled to the eccentric element and arranged to move on the slide guide to move the leg relative to the rotation blocker upon rotation of the actuator shaft between the leg-locking and leg-unlocking orientations.

5. The table of claim 4, wherein the leg actuator includes a handle arranged to rotate the actuator shaft.

6. The table of claim 4, wherein the slide is formed to include an aperture and the eccentric element is arranged for movement in the aperture upon rotation of the actuator shaft.

7. The table of claim 4, wherein the slide guide is a channel formed in a frame member included in the table and coupled to an underside of the table top for support thereof and the slide is positioned inside the channel for rectilinear movement therein between the leg-locking and leg-unlocking orientations.

8. The table of claim 7, wherein the leg includes a leg member and a leg support coupled to the leg member and the slide for rotation of the leg member between the extended and collapsed orientations, the rotation blocker is a tab positioned inside the channel, and the leg support engages the tab to lock the leg member in the extended orientation when the leg member is oriented in the extended orientation and the adjustment device is oriented in the leg-locking orientation and to lock the leg member in the collapsed orientation when the leg member is oriented in the collapsed orientation and the adjustment device is oriented in the leg-locking orientation and disengages the tab to allow rotation between the extended and collapsed orientations when the adjustment device is oriented in the leg-unlocking orientation.

9. The table of claim 8, wherein the leg support includes a support shaft and a bracket that is coupled to the support shaft and the leg member and includes a tongue coupled to the slide for rotation of the leg member between the extended and collapsed orientations, the tongue engages the tab to lock the leg member in the extended orientation when the leg member is oriented in the extended orientation and the adjustment device is oriented in the leg-locking orientation and to lock the leg member in the collapsed orientation when the leg member is oriented in the collapsed orientation and the adjustment device is oriented in the leg-locking orientation and disengages the tab to allow rotation of the leg member between the extended and collapsed orientations when the adjustment device is oriented in the leg-unlocking orientation, and the frame member is formed to include a tongue-receiving slot that receives the tongue upon movement of the adjustment device between the leg-locking and leg-unlocking orientations when the leg is oriented in the collapsed orientation.

10. The table of claim 7, wherein the leg includes a leg member and a leg support coupled to the leg member and the slide for rotation of the leg member between the extended and collapsed orientations, the frame member includes an inner surface formed to include the channel, an outer surface, and an end surface extending between the inner surface and the outer surface, the outer surface and the end surface provide the rotation blocker, and the leg support engages the end surface to lock the leg member in the extended orientation when the leg member is oriented in the extended orientation and the adjustment device is oriented in the leg-locking orientation, engages the outer surface to lock the leg member in the collapsed orientation when the leg member is oriented in the collapsed orientation and the adjustment device is oriented in the leg-locking orientation, and disengages the end surface and the outer surface to allow rotation of the leg member between the extended and collapsed orientations when the adjustment device is oriented in the leg-unlocking orientation.

11. The table of claim 10, wherein the leg support includes a support shaft and a bracket that is coupled to the support shaft and the leg member and includes a plate and a tongue that is perpendicular to the plate and coupled to the slide for rotation of the leg member between the extended and collapsed orientations, the plate engages the end surface to lock the leg member in the extended orientation when the leg member is oriented in the extended orientation and the adjustment device is oriented in the leg-locking orientation, engages the outer surface to lock the leg member in the collapsed orientation when the leg member is oriented in the collapsed orientation and the adjustment device is oriented in the leg-locking orientation, and disengages the end surface and the outer surface to allow rotation of the leg member between the extended and collapsed orientations when the adjustment device is oriented in the leg-unlocking orientation, and the frame member is formed to include a tongue-receiving slot that extends from the end surface and receives the tongue upon movement of the adjustment device between the leg-locking and leg-unlocking orientations when the leg is oriented in the collapsed orientation.

12. The table of claim 1, wherein the rotation blocker is a portion of a frame member included in the table and coupled to an underside of the table top for support thereof.

13. A table comprising a table top, a leg arranged to rotate between extended and collapsed orientations, and a leg lock including an adjustment device and a rotation blocker arranged as tab of a frame member included in the table to support the table top, the adjustment device being arranged to move rectilinearly between leg-locking and leg-unlocking orientations to move the leg relative to the tab, wherein, in the leg-locking orientation, the tab engages the leg to block rotation of the leg between the extended and collapsed orientations to lock the leg in the extended orientation when the leg is oriented in the extended orientation and to lock the leg in the collapsed orientation when the leg is oriented in the collapsed orientation and, in the leg-unlocking orientation, the leg is spaced apart from the tab for movement of the leg between the extended and collapsed orientations.

14. A table comprising a table top, a leg arranged to rotate between extended and collapsed orientations, and a leg lock including an adjustment device and a rotation blocker arranged as tab of a frame member included in the table to support the table top, the adjustment device being arranged to move between leg-locking and leg-unlocking orientations to move the leg relative to the tab, wherein, in the leg-locking orientation, the tab engages the leg to block rotation of the leg between the extended and collapsed orientations to lock the leg in the extended orientation when the leg is oriented in the extended orientation and to lock the leg in the collapsed orientation when the leg is oriented in the collapsed orientation and, in the leg-unlocking orientation, the leg is spaced apart from the tab for movement of the leg between the extended and collapsed orientations, wherein the frame member includes a channel, the tab is positioned inside the channel, the adjustment device includes a slide arranged for movement inside the channel, and the leg includes a tongue coupled to the slide and arranged to extend inside the channel and engage the tab upon movement of the slide to the leg-locking orientation.

15. The table of claim 14, wherein the adjustment device includes a leg actuator including a rotatable actuator shaft and an eccentric element coupled to the actuator shaft in eccentric relation thereto for rotation therewith and the slide includes an aperture receiving the eccentric element for movement of the eccentric element therein upon rotation of the actuator shaft.

16. The table of claim 13, wherein the leg includes first and second leg members and a leg member support arranged to support the first and second leg members for rotation between the extended and collapsed orientations, the leg lock includes a second rotation blocker arranged as second tab of a second frame member included in the table to support the table top, and the adjustment device includes a handle arranged to move the leg member support against the first and second tabs to block rotation of the first and second leg members between the extended and collapsed orientations to lock the first and second leg members in the extended orientation when the first and second leg members are oriented in the extended orientation and to lock the first and second leg members in the collapsed orientation when the first and second leg members are oriented in the collapsed orientation and to move the leg member support away from the first and second tabs to allow rotation of the first and second leg members between the extended and collapsed orientations.

17. A table comprising a table top, a leg arranged to rotate relative to the table top between extended and collapsed orientations, and a leg lock including an adjustment device and a rotation blocker arranged as first and second surfaces of a frame member included in the table to support the table top, the adjustment device being arranged to move rectilinearly between leg-locking and leg-unlocking orientations to move the leg relative to the first and second surfaces, wherein, in the leg-locking orientation, the first surface engages the leg to block rotation of the leg from the extended orientation to the collapsed orientation to lock the leg in the extended orientation when the leg is oriented in the extended orientation and the second surface engages the leg to block rotation of the leg from the collapsed orientation to the extended orientation to lock the leg in the collapsed orientation when the leg is oriented in the collapsed orientation and, in the leg-unlocking orientation, the leg is allowed to move between the extended and collapsed orientations.

18. A table comprising a table top, a leg arranged to rotate relative to the table top between extended and collapsed orientations, and a leg lock including an adjustment device and a rotation blocker arranged as first and second surfaces of a frame member included in the table to support the table top, the adjustment device being arranged to move between leg-locking and leg-unlocking orientations to move the leg relative to the first and second surfaces, wherein, in the leg-locking orientation, the first surface engages the leg to block rotation of the leg from the extended orientation to the collapsed orientation to lock the leg in the extended orientation when the leg is oriented in the extended orientation and the second surface engages the leg to block rotation of the leg from the collapsed orientation to the extended orientation to lock the leg in the collapsed orientation when the leg is oriented in the collapsed orientation and, in the leg-unlocking orientation, the leg is allowed to move between the extended and collapsed orientations, wherein the first surface is an end surface of the frame member, the second surface is an outer surface of the frame member, and the frame member includes an inner surface formed to include a channel, the adjustment device includes a slide arranged for movement inside the channel, and the leg includes a tongue arranged to extend inside the channel and coupled to the slide and a plate coupled to the tongue to engage the end surface to lock the leg in the extended orientation and to engage the outer surface to lock the leg in the collapsed orientation.

19. The table of claim 18, wherein the adjustment device includes a leg actuator including a rotatable actuator shaft and an eccentric element coupled to the actuator shaft in eccentric relation thereto for rotation therewith and the slide includes an aperture receiving the eccentric element for movement of the eccentric element therein upon rotation of the actuator shaft.

20. The table of claim 17, wherein the leg includes first and second leg members and a leg member support arranged to support the first and second leg members for rotation between the extended and collapsed orientations, the leg lock includes a second rotation blocker arranged as third and fourth surfaces of a second frame member included in the table to support the table top, the first and third surfaces are end surfaces of the frame members, the second and fourth surfaces are outer surfaces of the frame members, and the adjustment device includes a handle arranged to move the leg member support against the end surfaces to block rotation of the first and second leg members from the extended orientation to the collapsed orientation to lock the first and second leg members in the extended orientation and to move the leg member support against the outer surfaces to block rotation of the first and second leg members from the collapsed orientation to the extended orientation to lock the first and second leg members in the collapsed orientation.

* * * * *